US009551196B2

(12) United States Patent
Layden

(10) Patent No.: US 9,551,196 B2
(45) Date of Patent: Jan. 24, 2017

(54) DUAL DEVICE APPARATUS AND METHODS USABLE IN WELL DRILLING AND OTHER OPERATIONS

(71) Applicant: Reginald Waye Layden, Calgary (CA)

(72) Inventor: Reginald Waye Layden, Calgary (CA)

(73) Assignee: Raptor Rig, Inc., Calgary (CA)

( * ) Notice: Subject to any disclaimer, the term of this patent is extended or adjusted under 35 U.S.C. 154(b) by 215 days.

(21) Appl. No.: 14/468,703

(22) Filed: Aug. 26, 2014

(65) Prior Publication Data

US 2016/0060982 A1 Mar. 3, 2016

(51) Int. Cl.

| | |
|---|---|
| ***E21B 19/06*** | (2006.01) |
| ***E21B 19/16*** | (2006.01) |
| ***E21B 15/00*** | (2006.01) |
| ***E21B 19/07*** | (2006.01) |
| ***E21B 19/15*** | (2006.01) |

(52) U.S. Cl.

CPC ..... *E21B 19/16* (2013.01); *E21B 15/003* (2013.01); *E21B 19/06* (2013.01); *E21B 19/07* (2013.01); *E21B 19/155* (2013.01)

(58) Field of Classification Search

CPC ..... E21B 19/16; E21B 19/155; E21B 19/07; E21B 15/003; E21B 19/06

See application file for complete search history.

(56) References Cited

U.S. PATENT DOCUMENTS

| | | | | |
|---|---|---|---|---|
| 6,536,520 | B1 | 3/2003 | Snider et al. | |
| 8,151,909 | B2 | 4/2012 | Mittel et al. | |
| 2010/0186960 | A1* | 7/2010 | Reitsma | E21B 21/106 166/305.1 |
| 2011/0214919 | A1* | 9/2011 | McClung, III | E21B 3/02 175/57 |
| 2012/0000671 | A1* | 1/2012 | Krohn | E21B 19/14 166/380 |
| 2014/0352978 | A1* | 12/2014 | Eilertsen | E21B 3/02 166/380 |
| 2016/0024852 | A1* | 1/2016 | Kannegaard | E21B 15/02 175/5 |

FOREIGN PATENT DOCUMENTS

CA 2853797 A1 8/2013

OTHER PUBLICATIONS

Office Action dated Nov. 18, 2015, issued by Canadian Intellectual Property Office in Canadian Application No. 2,863,087.

International Search Report and Written Opinion dated Nov. 4, 2015, issued by the Patent Cooperation Treaty in International Application No. PCT/CA2015/050817.

Office Action dated Aug. 4, 2016, issued in Canadian patent application 2,863,087.

* cited by examiner

*Primary Examiner* — Robert E Fuller
*Assistant Examiner* — Steven MacDonald
(74) *Attorney, Agent, or Firm* — Ramey & Schwaller, LLP

(57) ABSTRACT

The present disclosure relates generally to devices and methods useable during well drilling operation. More particularly, the present disclosure pertains to a drilling rig incorporating a dual top drive apparatus useable for decreasing connection time of pipe segments useable during well drilling or other well operations, and methods of connecting pipe segments useable during well drilling or other operations.

6 Claims, 16 Drawing Sheets

DUAL DEVICE APPARATUS AND METHODS USABLE IN WELL DRILLING AND OTHER OPERATIONS

FIELD

The present disclosure relates generally to devices and methods useable during well drilling operation. More particularly, the present disclosure pertains to a drilling rig incorporating a dual pipe rotational device apparatus useable for decreasing connection time of pipe segments useable during well drilling or other well operations, and methods of connecting pipe segments useable during well drilling or other operations.

BACKGROUND

Conventional rotary drilling is performed using a rotary table, which includes a motor mounted on or below the derrick floor for rotating the table, and a Kelly which rationally connects the table to a drill string. Alternative drilling systems have been increasingly used, in which the pipe string drive has been modeled after a drilling unit, including a section of pipe connectable to the upper end of the drill string, and a motor for rotating the upper pipe section to turn the string. In recent years, rotary table drilling units are being replaced with these direct drive drilling units (e.g. top drives, kelly drives).

A typical direct drive drilling unit includes a motor drive assembly and a pipe handling assembly. The drive assembly includes a motor connected to the drill string by a cylindrical drive sleeve drilling extending downwardly along the centerline of the well from the drill motor. A direct drive unit is normally suspended from a travelling block for vertical travel supported by a derrick assembly. The drilling unit can be mounted on a carriage connected to a pair of vertical guide rails secured to the derrick.

Drilling is accomplished by the powered rotation of the drill string by the drill motor. The drill string is composed of loose drill string elements with a cutting tool or a bit fixed on the end of a drill string. The drill string elements consist mainly of a piece of pipe, which is provided on either side with fixing elements (e.g. threads) for connecting together adjacent pipe segments. This entire powered drilling assembly can then be moved upwardly and downwardly, with the string, to drive the string directly, without requiring a Kelly and Kelly bushing type connection. The cutting tool and/or drill bit can be threadably connected to the lower end of the drill string which, through the rotational energy supplied by the drill motor, cuts through the earth formation and deepens the well.

During drilling operations, the drilling tool is guided into and through earth formation by using a drill string. Additional drill string elements (e.g. segments of drill pipe) are repeatedly added to the upper end of the drill string, so that the drilling tool can extend ever further down-well. Assembling such a drill string takes a relatively long time, especially when a large number of pipe sections are assembled in the course of drilling a deep well.

Additionally, when it is necessary to perform maintenance and/or repairs on a drill string or tools attached thereto, the amount of time required for such an undertaking increases substantially as the depth of a well increases. For example, as the well is drilled, the bit becomes worn and the cutting elements thereof must periodically be replaced. To access a drill bit, the entire drill string must be removed from the well. Other types of damage and/or wear can also require raising the drill string. During the hoisting operation, the drill string is at least partially disassembled (e.g. the drill string is often separated into sections of three joined pipe segments). The time required to raise and disassemble can therefore be substantial.

As such, when replacement of the bit or other types of repairs, replacement, and/or remedial operations become necessary, at least a portion of the drill string is removed from the well, pulled above the derrick floor, and moved to a pipe storage rack on the derrick or similar location. Subsequent drill string elements are pulled from the well, exposing the next pipe section above the floor, which is similarly removed. This sequence, usually referred to as tripping out, is continued until the necessary portion of the drill string, which can include the entire drill string, is removed from the well. After replacement of the drill bit and/or completion of other remedial operations, the drill string is then reassembled, e.g. tripped in, by reconnecting and lowering all of the pipe sections previously removed.

As drilling depths and the length of wellbores increases, drilling efficiency must be increased and/or new techniques developed to offset the costly day rates for retaining and operating equipment capable of addressing deep well applications. To prevent a great deal of time from being lost when assembling or dismantling a drill string, a need exists for devices and methods that decrease the time required to disconnect drill string segments and raise a drill string.

A need also exists for apparatus and methods that can quickly and continuously prepare pipe members for connection, while concurrently performing drilling operations.

A further need exists for a drilling apparatus having multiple pipe hoisting and driving capabilities available and/or proximate to one another for the purpose of connecting and/or lowering a pipe segment, while a second pipe segment is engaged and prepared for connect.

A need exists for efficiently communicating drilling fluid into the drill string without requiring deactivation of the drilling fluid pump while successive drilling string segments are being connected.

Embodiments usable within the scope of the present disclosure meet these needs.

SUMMARY

Certain embodiments of the invention herein pertain to a rig. In certain embodiments, the rig comprises a plurality of pipe rotational devices; a derrick assembly for supporting the plurality of pipe rotational devices, wherein each of the plurality of pipe rotational devices is slidably disposed within the derrick assembly to move the pipe rotational devices toward a wellbore and away from a wellbore, the wellbore having a wellbore axis; and a plurality of lifting assemblies, wherein the plurality of lifting assemblies are operatively connected to the plurality of pipe rotational devices and each lifting assembly is capable of moving a pipe rotational device of the plurality of pipe rotational devices toward the wellbore and away from the wellbore. In this embodiment, each of the plurality of pipe rotational devices is capable of moving in a perpendicular direction relative to the wellbore. In other embodiments of the aforementioned invention, the derrick assembly is capable of sliding from wellbore to wellbore.

In still further embodiments pertaining to the rig, each of the plurality of pipe rotational devices are spaced a fixed distance from each other in a plane perpendicular to the wellbore axis. In particular embodiments, there are two pipe rotational devices. Still further, in certain embodiments, each of the plurality of pipe rotational devices move simultaneously in an axis perpendicular to the wellbore axis.

Other embodiments of the inventions herein pertain to the pipe rotational device, wherein the device is a top drive. In these embodiments, the top drive comprises the following: a housing with a top end and a bottom end; a drive shaft disposed within the housing, the drive shaft capable of rotating in an axis perpendicular to the axis of a wellbore; an elevator assembly positioned within the housing proximal to the drive shaft; a clamp assembly disposed within the housing; and wherein the rotational device is capable of coupling a top end of a pipe segment to the top drive, and wherein the clamp assembly is capable of immobilizing the pipe segment.

In further embodiments of the top drive, the clamp assembly is capable of moving the top end of the pipe segment toward the drive shaft.

Other embodiments concern a method of assembling a pipe segment string using some of the aforementioned pipe rotational devices. This method comprises: coupling a first pipe segment having a top and a bottom end with a first pipe rotational device; moving the first pipe segment in a horizontal direction relative to a wellbore axis; engaging the first pipe segment with a pipe string in the wellbore; lowering the first pipe segment into the wellbore; coupling a subsequent pipe segment to a subsequent pipe rotational device; moving the subsequent pipe segment having a top and a bottom end in a horizontal direction relative to the wellbore axis; and engaging the bottom end of the subsequent pipe segment with the top end of the first pipe segment and lowering the subsequent pipe segment into the wellbore.

In certain embodiments, this method further comprises, wherein coupling a pipe segment to a pipe rotational device comprises: engaging a pipe segment with the elevator assembly; engaging the pipe segment with the clamp assembly; lifting the pipe segment upward to contact a pipe rotational device; and coupling the top end of the pipe segment to the drive shaft.

Other embodiments of the invention herein pertain to a method of moving a pipe segment using the aforementioned pipe rotational devices. In this embodiment, the method comprises: moving the pipe segment from a first position over the wellbore to a second position wherein the top end of the pipe segment is in contact with the rotational device and the pipe segment is not over the wellbore.

Further embodiments of the invention concern a method of lifting a pipe segment having a bottom end and a top end, using the aforementioned top drive, wherein the elevator assembly lifts the pipe segment a pre-defined distance to provide a certain clearance between the bottom end of the pipe segment and the wellbore. Additionally, in certain embodiments, the elevator assembly device comprises two rotators in an axis substantially parallel with one another and an outer diameter of the pipe segment is determined by a distance between the two rotators. Still further, in certain embodiments, the pipe segment is clamped by the clamp assembly to prevent rotation and vertical travel of the pipe assembly when the pipe segment is over the wellbore.

In other embodiments concerning assembling a pipe segment string, additional methods call for the prevention of venting gas from the wellbore into the atmosphere by employing at least one pipe segment with a check valve operatively connected to the pipe segment. In such embodiments, the check valve is opened by engaging the top drive with the pipe segment.

Other embodiments concerning the assembling of the pipe segment string include communicating a drilling fluid into a fluid passageway of at least one pipe segment lowered into the wellbore. In such embodiments, the drilling fluid is diverted from the fluid passageway during a connection operation wherein one pipe segment is being connected to another pipe segment. Likewise, upon connecting one pipe segment to the other pipe segment, diverting the drilling fluid back to the fluid passageway. In these embodiments, the drilling fluid is diverted to a storage container.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In order that the manner in which the above-recited and other enhancements and objects of the invention are obtained, we briefly describe a more particular description of the invention briefly rendered by reference to specific embodiments thereof which are illustrated in the appended drawings. Understanding that these drawings depict only typical embodiments of the invention and are therefore not to be considered limiting of its scope, we herein describe the invention with additional specificity and detail through the use of the accompanying drawings in which.

LIST OF REFERENCE NUMERALS

Figure 1:
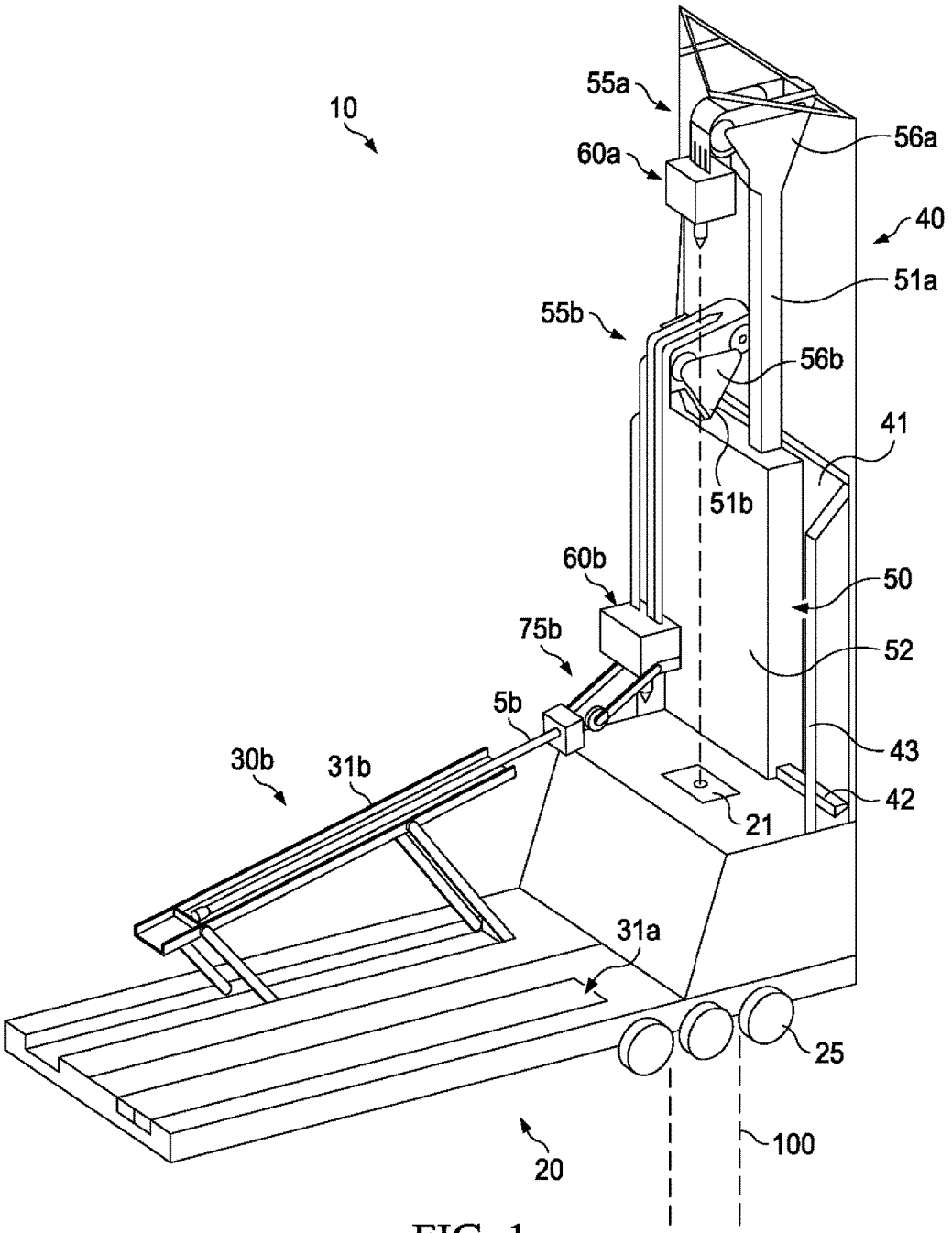
FIG. 1 depicts an isometric view of an embodiment of a mobile drilling rig useable within the scope of the present disclosure.

5*a* pipe segment
10 drill rig
20 base structure
30 pipe feeding assembly
31*a* feeder ramp
40 derrick assembly
41 upper rail
42 lower rail
43 stabilizing beams
50 raising assembly
51*a*, 51*b* booms
52 ram assembly
55*a*, 55*b* hoist assembly
60*a*, 60*b* top drive assemblies
61 drive section
62*a* support section
63*a* drive shaft
64*a* collar
65*a* external springs
66*a* stop blocks
70*a* backup clamp
71*a*, 72*a* backup clamps
73*a*, 74*a* clamp links
75*a* elevator
76*a* joint elevator
77*a* elevator links
77*a*, 77*b* pneumatic cylinders
78*a*, 78*b* tapered segments
79*a*, 79*b* radially displaced tapered segments

DETAILED DESCRIPTION

Introduction

We show the particulars shown herein by way of example and for purposes of illustrative discussion of the preferred embodiments of the present invention only. We present these particulars to provide what we believe to be the most useful and readily understood description of the principles and conceptual aspects of various embodiments of the invention. In this regard, we make no attempt to show structural details of the invention in more detail than is necessary for the fundamental understanding of the invention. We intend that the description should be taken with the drawings. This should make apparent to those skilled in the art how the several forms of the invention are embodied in practice.

We mean and intend that the following definitions and explanations are controlling in any future construction unless clearly and unambiguously modified in the following examples or when application of the meaning renders any construction meaningless or essentially meaningless. In cases where the construction of the term would render it meaningless or essentially meaningless, we intend that the definition should be taken from Webster's Dictionary 3rd Edition.

As used herein, the term "attached," or any conjugation thereof describes and refers to the at least partial connection of two items.

As used herein, the term "proximal" refers to a direction toward the center of the valve.

As used herein, the term "distal" refers to a direction away from the center of the valve.

As used herein, slidably connected referrers to one component abutting another component wherein one component is capable of moving in a proximal or distal direction relative to the other component.

As used herein, "pipe" or "pipe segment" refers to an elongated tube with a hollow interior extending from the upper end to the lower end to allow fluid to transfer from the top or upper end to the bottom or lower end. The elongated tube can have any shape such as circular, square, triangular and the like. A pipe is a tubular herein.

As used herein, a fluid is a gas or liquid capable of flowing through a pipe.

Moreover, we intend that various directions such as "upper" or "lower", "bottom", "top", "left", "right" and so forth are made only with respect to explanation in conjunction with the drawings. However, in certain instances the components are oriented differently, such as during transportation, manufacturing and in certain operations and that the components are often able to be oriented differently, for instance, during transportation and manufacturing as well as operation. Because we teach many and varying embodiments within the scope of the concepts, and because many modifications are discussed in the embodiments described herein, we intend that that the details herein should be interpreted as illustrative and non-limiting.

Additionally, as used herein, a "pipe rotational device" in general refers to any pipe rotational device that can be used in accordance with the disclosure herein for facilitating the installation and retrieval of pipe segments used in downhole operations. Examples of pipe rotational devices which can be used in accordance with the disclosure include top drives, Kelly drives, drilling chuck, power swivel and the like.

Operation

Top drive A is inline with the well bore drilling, the next step is making an off-hole connection. In operation, a pipe segment is indexed into a pipe handler on which a top drive is to spud or continue drilling by an automated pipe rack system. The pipe handler then elevates the pipe segment into a position for pickup by top drive B, assuming in this operation that there are two pipe handlers, two top drives, one mast and one wellbore.

The pipe handler then elevates the pipe segment up into position for pick up by top drive B, which is presently situated in line with the first pipe handler, itself which is off the center of the wellbore at a predetermined height to enable top drive B to come down and latch the pipe segment. The first pipe handler then slides the pipe segment past the end of the handler to the appropriate distance thereby allowing top drive B clearance to come down and latch on with its elevators behind the upset on the pipe.

The length and position of the pipe is ascertained by a switch at the end of the handler and an encoder on the sliding drive mechanism. This combined with the PLC knowing what size of pipe it is (and thus what thread) (can be determined by weight (load pins or hydraulic pressure) or by manual input of this data) so pin length can be subtracted from total to ensure accuracy. Thus allowing the pipe tally to be automatically tracked and displayed by the PLC real time in the doghouse. This enables the PLC (programmable logic control) to "manage" the pipe tally (actual depth), pipe in hole, pipe coming out of hole, XO (thread change cross overs)'s needed etc. enabling proactive messages to be prompted to the operator (i.e. "XO and TD (top drive thread saver subs/XO from 4½XH extra hole (type of thread for example) to 3½IF internal flush (type of thread for example) needed next connection") eliminating the human error aspect and increasing efficiency.

Top drive B's bales are extended and come down onto the pipe accordingly to enable the elevators to be latched and confirmed closed (confirmation either manually or hydraulic/PLC). The angle of the elevators will be manipulated by small rams to hold the proper angle in order to further assist proper latching. Once latching has been accomplished, top drive B begins to hoist to the predetermined height determined by the pipe segment's length considering the height needed to get over the connection at the wellhead. This knowledge of height is accomplished by encoders on the hoisting mechanism that monitor the top drive height constantly. The rams will dump back to tank allowing the elevators to free hang or just add some resistance with an accumulator or orifice to reduce swing when tailing off the end of the first pipe handler of which could be further extended to aid as well, or top drive B will keep the bails extended until fully hoisted and the pipe segment comes off the first pipe handler vertically then allowing the bail cylinders to bring the pipe segment directly below the top drive quill in a controlled manner in order to eliminate swing. This position and distance (in either case) will be determined by collapsed length of the ram and always the same.

The backup clamp on top drive B now extends down to grab the top of the pipe segment and bring it up into the quill to enable top drive B to screw into it and torque it to said connections' predetermined specified limit (specified since the PLC knows what the thread is from the information gathered prior, again reducing potential human error).

Alternatively, a pipe arm (or other pipe handling devices known in the industry) could deploy the pipe into alignment with the top drive and then travel vertically to engage the thread or the top drive could travel vertically.

In order to determine the height needed for thread make up travel, the collapse or extension, depending on the process at the time, distance or position of the floating quill (shock sub, etc.) will be determined by a sensor (encoder, proximity switch etc.) placed accordingly on the floating quill/top drive to inform the PLC where and when to stop contraction (or extension) of the backup clamp. This is combined with the proper automated (pipe supplier recommended) make up procedure i.e.—back one turn (to jump one thread lightly)—rotate clockwise 3 times quickly—slow on make-up turn in rotation in order to establish perfect make up torque. This information will save threads eliminating even more potential human error. It will also alert (off hole) the operator if there are any discrepancies in the makeup procedure, for example if there were too many rotations for the make-up process potentially meaning damaged or incorrect thread mating and now the operator can evaluate before it become a serious issue on or in the hole.

Pipe torque will be determined by amps (ac) or hydraulic pressure (psi) and controlled by the PLC based on its understanding of the thread in question in order to know the minimum number of turns required to spin in or out, etc.

Typically, the backup clamp is able to hold torque of the top drive in both directions and elevate the tubular in question. Once the pipe is made up to the top drive, the clamp will lower the pipe to the end of the stroke of the floating quill (shock sub, etc.), determined by the aforementioned linear sensor and released.

Top drive B now waits "off hole" for top drive A to finish drilling down its pipe.

The second step is bringing the "off hole" connection over the wellbore to complete final steps of the drilling connection. In this step, top drive B is now slid over the wellbore hole center, and in turn, sliding top drive A off hole and in-line with the second pipe handler, thus allowing it to run through the first step as well with the pipe elevated just above the known stick up height of the pipe top drive B had just landed. This knowledge is from the PLC working with the hoisting system encoder or similar positioning device. This information recorded from when second top drive unscrewed from the prior pipe.

Next, top drive B is lowered so the first pipe segment's pin end enters the pipe that is set in hyd slips ("chuck slips" or "clamp slip combo" will be used). This application is preferred if there is a potential for a "pipe light" situation due to UBD (under balanced drilling) or "live well" operations. Top drive B now spins the pipe together to the proper torque (determined as above by the PLC) for that connection. The bottom half of the connection is held (if necessary—chuck or clamp slips combined with string weight may be enough to not need iron roughneck for back up) by the iron roughneck and used to make up the connection if the size of the connection calls for more torque than the top drive can achieve.

If the operation happens to be one of a UBD or "live well" nature and gas is being used to drill with (or well pressure is present and contained at surface), the pipe can be equipped with a "check pipe" system. This will enable the operator to "break out" and continue connections seamlessly without time waiting for bleed down of the previous pipe drilled (due to the expansion of $N_2$, for example). In the reverse function (tripping out) it will also allow the operator to be bleeding "just" the pipe being hoisted. By reducing the volume being bled it is able to be done by the time said pipe is finished hoisting thus providing the most time efficient UBD or "live well" connection possible. This bleeding would be directed back to the degassed automatically using the pumping manifold (to be described later) of which will have pressure sensors to confirm pressure is completely bled and safe to continue. The "check pipe" system consists of small one way check valves installed in the box end of the each pipe of which can be opened selectively and bled individually by the top drive when desired, for example on the trip out.

Once the PLC has determined proper makeup has been achieved, the pumping manifold (automatically via PLC and remote control valves) redirects the drilling medium flow through top drive B and in turn down the pipe, now circulation has been re-established and confirmed. In this case, the fluid could be any medium used for drilling (e.g. $N_2$ or air.) The PLC will take weight with top drive B based on the last known weight from top drive A and slightly elevate so automatic slips (chuck or clamp) can be released enabling top drive B to then go down to pick up the depth, which was also recorded by data from top drive A, and then reinstate the preset drilling parameters from top drive A to top drive B.

Top drive B will be able to hoist out of slips and aggressively return to bottom smoothly returning to the drilling parameters just used by the second top drive as the PLC will have recorded and transferred the desired parameters and data to top drive B (such as exact weight, height and pick up/depth). This method is able to reduce human error (spudding bottom, etc.) This method, combined with the ability to recognize and remember toolface (centralizer system incorporated with the chuck slip/clamp slip) can be utilized to aid in tool face tracking in case of slippage beyond just relying on the (top drive) transducers last position. This has the ability to be an extremely efficient tool for directional drillers to pre-program their desired parameters well ahead of time with precision. For example, if the directional drillers needs 15 m slide then 10 m rotation (at specified rate), then 50 m high side reciprocating followed by a survey, the PLC will have the information to accommodate precisely using all the inputs described above in all the previous steps. The end goal would be for one man to be able to directionally drill multiple rigs without even being present as all this data can be shared digitally/wirelessly, etc.

All limits and settings on any of the rigs' operational parameters will be set by the individual responsible for said parameter, without fear of change by operator or unqualified personnel without permission as these can be locked by individual codes. As a non-limiting example, only the company representative could approve pulling the casing over 300,000 lbs. Thus, in this example, the only way this will be achieved is if the company representative puts his code in and makes it so. All parameter changes and control trends/events will be recorded for assistance in future troubleshooting and root cause analysis.

The third step in the process is finishing top drive B's currant drilling connection and preparing for top drive A to drill its next simultaneously prepared connection as in the previous steps. In this operation, using an upstream pumping manifold, the flow will have been previously redirected to a route maintaining close to its drilling circulation pressure saw on the second top drive just before it had broken out of the previous pipe. A Kelly hose line will have been automatically drained, bled or even had suction pressure applied to it to limit drilling fluid escaping from top drive while unconnected. This enables the rig to make a connection without ramping and shutting down the pump, or multiple pumps, saving this time and the time it takes to put the pump, or pumps, back online at the desired parameters. It also reduces any potential adverse pump loading (stalling/synchronizing issues) when considering multiple pumps as the pumps will always be loaded in unison or the established load maintained. This redirected "route" can be wherever makes sense for the type of operation, e.g. in an overbalanced situation it could be put back to the shaker or down the flowline. In a managed pressure or underbalanced situation, the flow can be directed across the drilling cross (BOP well annulus) (or other path ending up at the chokes) and down through the chokes. This will help maintain a constant bottom hole pressure and limit the choke adjustments during connections. This aspect combined with the greatly reduced time for the connection greatly helps keep the BHP constant and the choke adjustments to a minimum.

In a MPD (managed pressure drilling) or UBD application, the chokes could be automated and relaying the information to the rigs PLC in order to regulate BHP (bottom hole pressure) during the connection (and while drilling for that matter) e.g. PLC knowing during an MPD connection when flow is diverted back through chokes directly that back pressure at that flow should be increased by equivalent circulating density. The PLC will already be equipped with most the information needed to maintain BHP at a set point by knowing the depth, drilling fluid weight, pump rate and pressure using transducers at the chokes. With this information we can also set a mean line on a graph for the PLC to adjust the choke setting to the operator's desired parameter i.e. to maintain pressure +– a set point or formation pressure as well as the potential incorporation of precise flow rate monitoring in and out of well. This can be described on a line graph showing formation pressure and volume differentials of which would give the operator early potential kick detection when drilling overbalanced or MPD.

Examples

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Referring now to FIG. 1, reference numeral (10) denotes a mobile drilling rig, hereafter referred to as a drill rig. The drill rig (10) comprises a base structure (20), a pipe feeding assembly (30), a derrick assembly (40), a raising assembly (50) and two top drive assemblies (60*a*, 60*b*).

The base structure (20) is shown having a generally flat rectangular surface, adapted to support the pipe feeding assembly (30) and the derrick assembly (40), which are shown integrated thereon. The base structure (20) is also shown with a plurality of wheeled axels (25) which can be used for mobility and (25) which can include a corresponding suspension system (not shown) and similar components to allow the drill rig (10) to be pulled by a standard truck (not shown) or similar vehicle, in the manner of a mobile trailer. A stabilizer, or multiple stabilizers, in certain applications are included in the base structure (20) for stabilizing the drill rig (10) during operations. For example, the base structure (20) could incorporate a plurality of support arms (not shown) that can be movable to contact the ground to provide leverage and/or stability to the drill rig (10).

The base structure (20) supports the derrick assembly (40), which provides structural support for the lifting assembly (50) and a pathway along which the lifting assembly (50) can move during drilling and/or lifting/lowering operations. As depicted, the lifting assembly (50) is not fixedly attached to the base (20). In certain applications, this allows for a variety of structural support mechanisms. The derrick assembly (40), for example, is able to provide sufficient structural support, as the lifting assembly (50) is subjected to significant compressive and bending loads during drilling operations when the booms (51*a*, 51*b*) and the ram assembly (52) move vertically and horizontally, respectively. In an embodiment, the derrick assembly (40) can be constructed as a lattice structure and can comprise a generally two dimensional or a three dimensional configuration. The depicted derrick assembly (40) is shown having a width approximately equal to the width of the base (20), and a height that extends above the booms (51*a*, 51*b*) of the lifting assembly (50). The derrick assembly (40) is also depicted with stabilizing beams, (43) shown extending toward the center of the base assembly (20) which provides the derrick assembly (40) with additional structural strength and stability.

Derrick assemblies, in general, are known in the drilling industry, and are well understood by those of ordinary skill in the art. Therefore, it should be understood that the derrick assembly (40) can be configured in any manner known in the industry sufficient to provide support for the lifting assembly (50). For example, a three dimensional derrick assembly (not shown) in certain applications can be used, having a shape of a narrow pyramid with a truncated top, with the guide rails attached along the side thereof. A three dimensional guide frame can provide additional strength and stability in supporting the lifting assembly (50), and in certain applications, this configuration is used, for example, in conjunction with larger drill rigs, which are designed to handle longer or wider diameter pipe segments, which are typically much heavier.

The guide mechanism for the lifting assembly (50) is shown including a pair of rails (41, 42) attached to the base assembly (20) and the derrick assembly (40), extending horizontally thereon. The lower rail (42) is shown attached to the base (20), while the upper rail (41) is shown attached to the derrick assembly (41). The ram assembly (52) can be movably connected to the rails, such as through use of two sets of rollers (not shown).

In the aforementioned embodiment of the ram assembly, wherein the ram assembly is movably connected to the rails, the rail and roller assemblies can be of any known construction sufficient to withstand the compressive and lateral forces applied by the lifting assembly as it supports the weight of the top drives (60*a*, 60*b*) as well as attached pipe segments (5*a*, 5*b*, shown in FIGS. 4A through 4D), which are suspended above the wellbore (100). Lower rollers (not shown) can be attached to the bottom surface of the ram assembly (52) to engage the lower rail (42), while upper rollers (not shown) can be attached to the upper portion of the ram assembly (52) and engage the corresponding upper rail (41). It should be understood that the specific number and type of rail and roller combinations is not limited to the described embodiment, and in certain applications will include any number and type of roller assemblies, or any other movable forms of engagement usable to allow horizontal motion of the lifting assembly (50) while providing sufficient structural strength to support the weight of the ram assembly (52), the booms (51*a*, 51*b*), and any other tools and components attached thereto during drilling operations.

The derrick assembly (40) can provide support for the lifting assembly (50), which can include the ram assembly (52) having first and second booms (51*a*, 51*b*) extending therefrom, the ram assembly (52) being adapted to move horizontally along the guide rails (41, 42). In certain applications, the ram assembly (52) can include an actuator to actuate the first and second booms (51*a*, 51*b*) in the vertical and horizontal directions. Such an actuator can include hydraulic cylinders (not shown) connected to the lower portion of the booms (51*a*, 51*b*), other types of fluid cylinders, mechanical actuators, or combination thereof. Upon actuation of a hydraulic cylinder or similar mechanism, the respective boom (51*a*, 51*b*) can be forced out of the ram assembly (52) e.g. in the upward direction, lifting a top drive (60*a*, 60*b*). A geared mechanism in certain applications or configurations use used to provide vertical motion of the booms (51*a*, 51*b*) and/or the horizontal motion of the lifting assembly (50). For example, the lifting assembly (50) in certain applications comprises an internal rack and pinion mechanism (not shown), whereby a pinion, which, depending on the size of the booms and the application, can be powered by an electrical motor or other motive and/or power source, engages teeth along the length of the booms (51*a*, 51*b*) causing movement in the vertical direction. As described above, the ram assembly (52) and the booms (51*a*, 51*b*) can also move horizontally (i.e. perpendicular to the well bore). Similar methods for actuating the booms (51*a*, 51*b*) and/or the ram assembly (52) to move in a horizontal direction are also used, such as one or more hydraulic cylinders (not shown) or similar elements attached to the base assembly (20) or the derrick assembly (40), with a piston rod attached to the ram assembly (52). Upon actuating the hydraulic cylinder the ram assembly (52) can be moved horizontally along guide rails (41, 42). Alternatively or additively, actuation of the ram assembly (52) in the horizontal direction can include a geared mechanism (not shown). For example, the ram assembly (52) can comprise a rack and pinion assembly (not shown), whereby a pinion, which can be powered by an electrical motor (not shown) or similar motive and/or power source, engages with and actuates a rack assembly (not shown) associated with the ram assembly (52), causing it to move horizontally along the guide rails (41, 42).

As further depicted in FIG. 1, each boom (51*a*, 51*b*) supports a cable winch (56*a*, 56*b*), which is a part of a hoist assembly (55*a*, 55*b*), usable for moving an associated top drive (60*a*, 60*b*) in the vertical direction. Each hoist assembly (55*a*, 55*b*), in combination with a boom (51*a*, 51*b*), can function in a manner similar to a crane, by extending and retracting a cable or wire to move the associated top drive (60*a*, 60*b*) vertically. For example, the vertical position of each top drive (60*a*, 60*b*) can be controlled by winding and unwinding cable drum (not shown) or a spool, which can be rotated by a motor (not shown) to control the height of the top drive (60*a*, 60*b*) relative to the opening (21). Any type of motor or other motive source (e.g. a hydraulically or electrically powered source, as well as any other known method for extending or retracting cable of sufficient force in this application, and resulting in vertical movement of the drive assembly, can be used. Likewise, moving the drive assembly in the vertical direction can be accomplished by any mechanism capable of providing sufficient force. As one example, the mechanism can include an internal rack and pinion mechanism whereby a pinion, which, depending on the size and mass of the drive assembly and its application, can be powered by an electrical motor or other motive and/or power source, engages teeth along the length of the mast booms (not shown) causing movement in the vertical direction. As another example, the lifting assembly can incorporate a traveling block with a series of sheaves and cables powered by a winch. In this example, the winch can be manually operated or powered by a motor. The lifting assembly can include a hydraulic ram connected to the top drive.

Figure 2B:
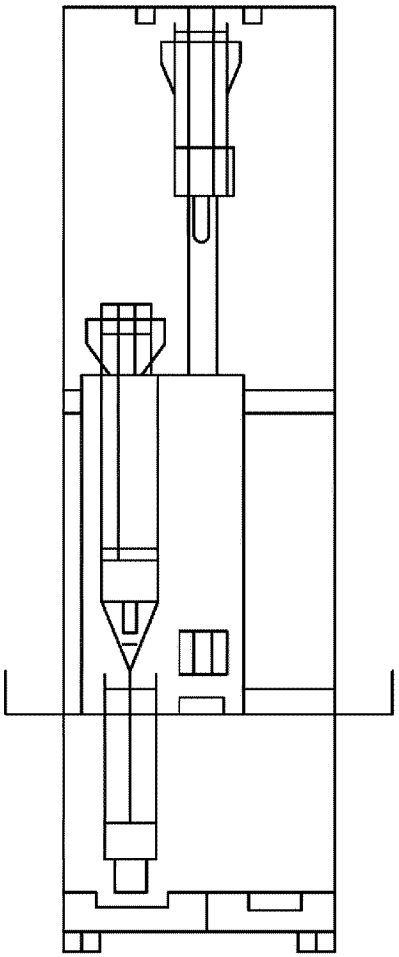
FIG. 2B depicts a front view of the mobile drilling rig shown in FIG. 1.
Figure 2A:
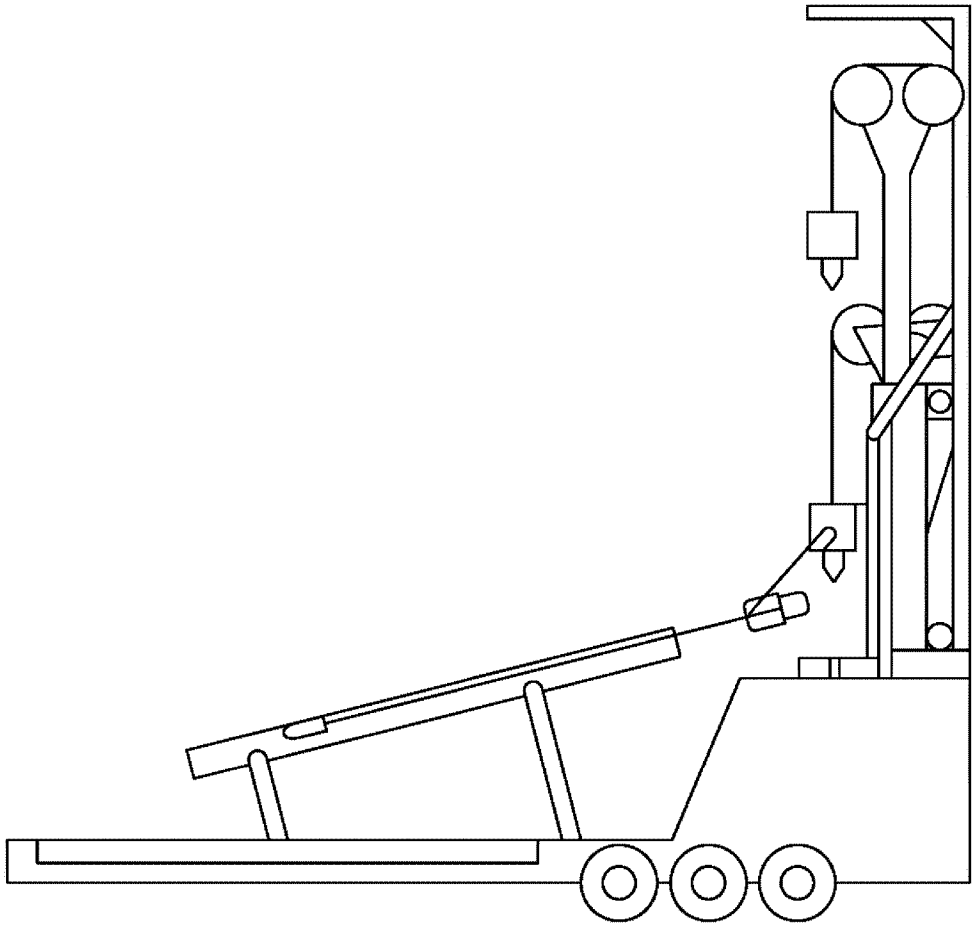
FIG. 2A depicts a side view of the mobile drilling rig shown in FIG. 1.
Figure 3B:
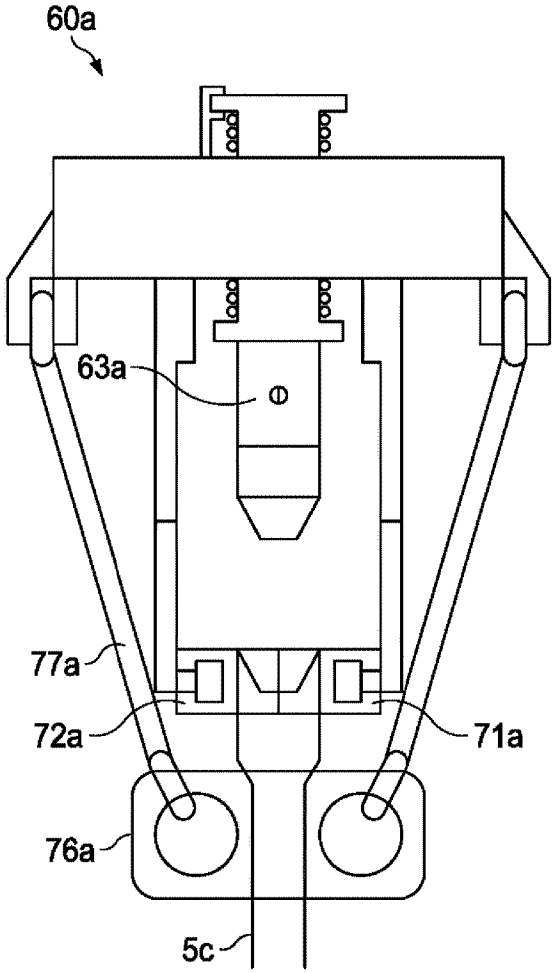
FIG. 3B depicts the top drive assembly and back-up clamp of FIG. 3A with the back-up clamp engaged with the pipe segment.
Figure 3A:
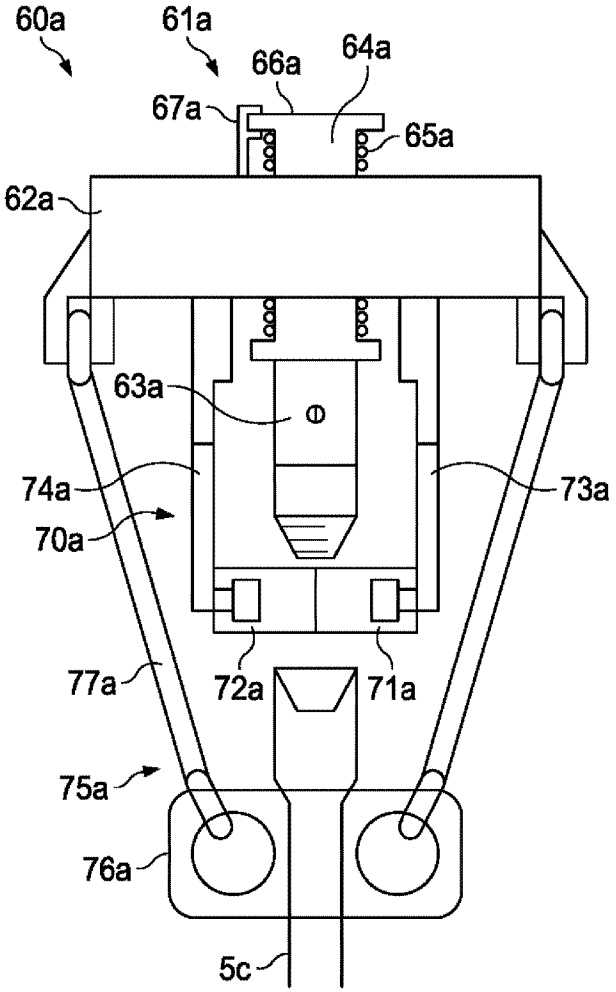
FIG. 3A depicts a diagrammatic front view of an embodiment of a top drive assembly and back-up clamp useable within the scope of the present disclosure, positioned above a pipe segment.

Top drive assemblies usable with the embodiments depicted in FIGS. 1, 2A, and 2B, are shown in FIGS. 3A-3D. FIG. 3A depicts a top drive assembly (60*a*); having a drive section (61*a*) an elevator assembly (75*a* comprising the elevator (76*a*) and the bail (77*a*) and a backup clamp (70*a*). Typically, elevator (76*a*) and the bail 77*a* swing out together to engage a tubular from the pipe handler. The drive section (61*a*) can include a motor (now shown), a transmission (not shown), a support section (62*a*), and an output shaft (63A). The depicted section (62*a*) serves as the central body of the top drive, having the other components attached thereto. The drive shaft (63*a*) is shown positioned through the center of the support section (62A), which during operation, can be used to threadably engage a pipe segment (5*a*) and drive a drill bit (not shown), located at the bottom end of a pipe string (not shown). In the depicted embodiment, the drive shaft (63*a*) maintains its position and the capacity to rotate within the support section (62*a*) via a collar (64*a*) located through the center of the support section (62*a*), positioned concentrically about the drive shaft (63*a*). The drive shaft (63*a*) can be retained within the collar (64*a*), while having the ability to rotate therein as the drive shaft is rotated by the motor/transmission systems. The drive shaft (63*a*) can transmits torque from the motor to a pipe segment (5*a*) connected thereto, thereby rotating the pipe string during drilling operations. The collar (64*a*) can be centralized (e.g., in a vertical position) through the support section (62*a*) by external springs (65*a*), located on either or both sides thereof, which can bias the collar (64*a*) to a preselected location relative to the base, the support section (62*a*) or another portion of the assembly. The springs (65*a*) can allow the drive shaft (63*a*) limited vertical movement in response to vertical forces applied thereto, as further explained below. The shaft collar (64*a*), also has stop blocks (66*a*) in certain applications for setting discrete limits on vertical motion of the drive shaft (63*a*) relative to the support section (62*a*). Other methods for providing the vertical travel in the drive shaft include, but are not limited to, compressive hydraulic cylinders and free floating sleeves.

In certain applications, an additional traveling block (not shown) is incorporated into the hoist assembly, and attached to the top drive (60*a*) with a lifting ring (not shown). It should be understood that while FIGS. 3A-3D depict one embodiment of a top drive assembly and the drive section (61*a*), any configuration having the capacity to drive the selected pipe segments is contemplated.

The pipe handling components of the top drive assembly (60*a*), shown extending from the support section (62*a*), can include an elevator assembly (75*a*) and a backup clamp assembly (70*a*). FIG. 3A depicts an embodiment in which the elevator assembly (75*a*) comprises a single joint elevator (76*a*) connected to the base via two elevator links (77*a*) (e.g., bail arms). A link tilt mechanism (not shown) can also be connected between the support section (62*a*) and the elevator links (77*a*), allowing the rotation of the elevator assembly (75*a*) during operation, enabling the single joint elevator (75*a*) to extend a pipe segment (5*a*) located on the feeder ramp (31*b*), as explained in detail below.

While the illustrations herein refer to an elevator assembly, other pipe lifting mechanisms such as pipe arms or dual mouse hole connections with a Kelly drive set up can be used.

Figure 3D:
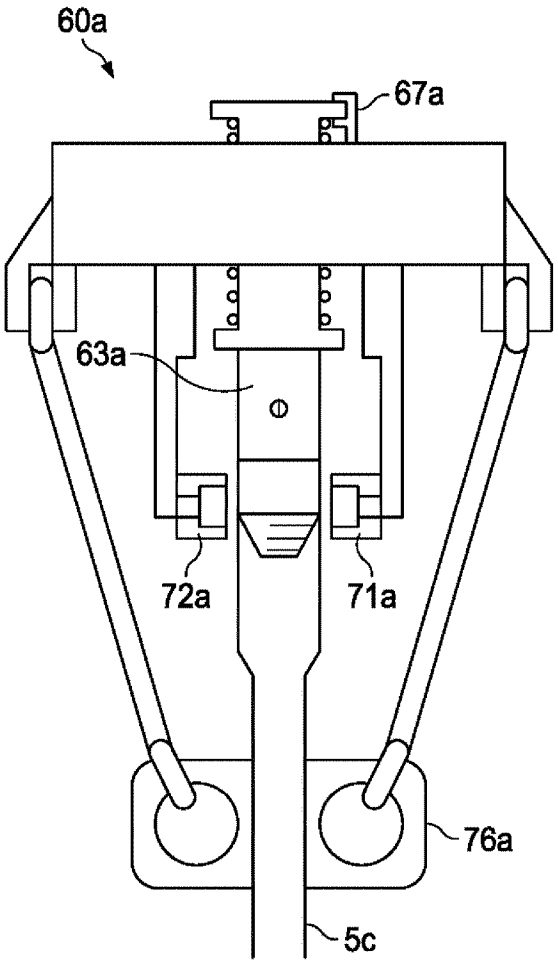
FIG. 3D depicts the top drive assembly and back-up clamp of FIG. 3A with the top drive engaged with the pipe segment.
Figure 3C:
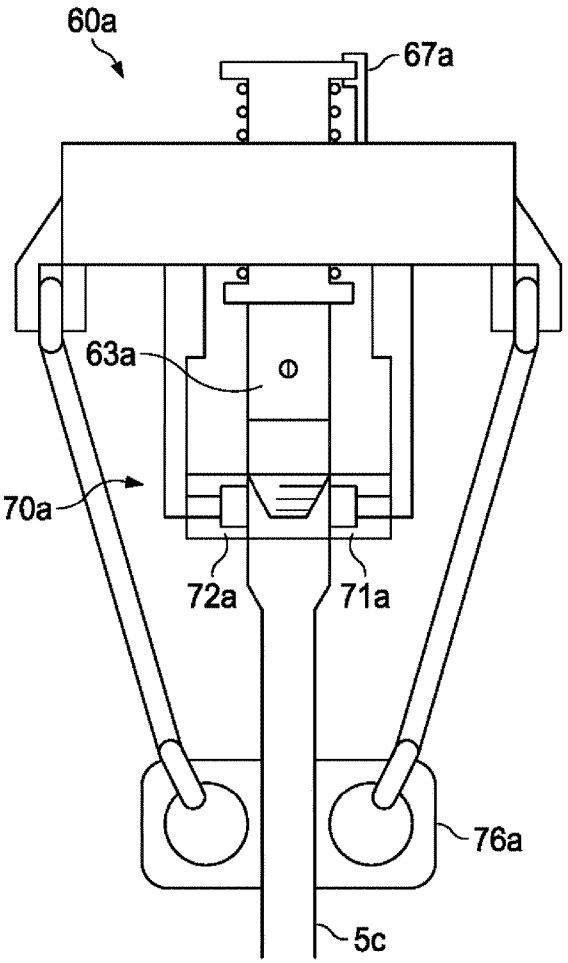
FIG. 3C depicts the top drive assembly and back-up clamp of FIG. 3A with both the back-up clamp and top drive engaged with the pipe segment.

As described above, FIG. 3A depicts a back-up clamp assembly (70*a*) associated with the top drive assembly. The depicted back-up clamp assembly (70*a*) is shown having two portions and/or halves, e.g. two back-up clamps (71*a*, 72*a*) and two clamp links (73*a*, 74*a*) that each engage a respective back-up clamp (71*a*, 72*a*) to the support section (62*a*). The links (73*a*, 74*a*) have the ability to extend and retract vertically, e.g. to move the clamps (71*a*, 72*a*) about the box end of the pipe segment (5*a*). As such, the back-up clamps (71*a*, 72*a*) are designed to grip and hold a pipe segment, preventing the pipe segment from moving vertically or rotating. Each back-up clamp (71*a*, 72*a*) can have a semicircular shape, complementary to the outside diameter of the pipe segment (5*a*), and an inside surface having teeth, slip inserts, or other gripping elements (not shown) designed to grip against the outside surface of the pipe segment (5*a*) and prevent relative movement between the pipe segment and the clamps. A hydraulic or pneumatic cylinder (not shown) connected between the base and the clamp links (73*a*, 74*a*), in certain applications, is used to move the back-up clamp assembly (70*a*) between the open and closed positions, as depicted in FIGS. 3C and 3D respectively. To enable vertical movement of the back-up clamps (71*a*, 72*a*), each clamp link (73*a*, 74*a*) can include a hydraulic or pneumatic cylinder (not shown) and the like. For example, the back-up clamps (71*a*, 72*a*) can be attached to the rod end of each cylinder to enable vertical extension and retraction thereof.

Figure 5:
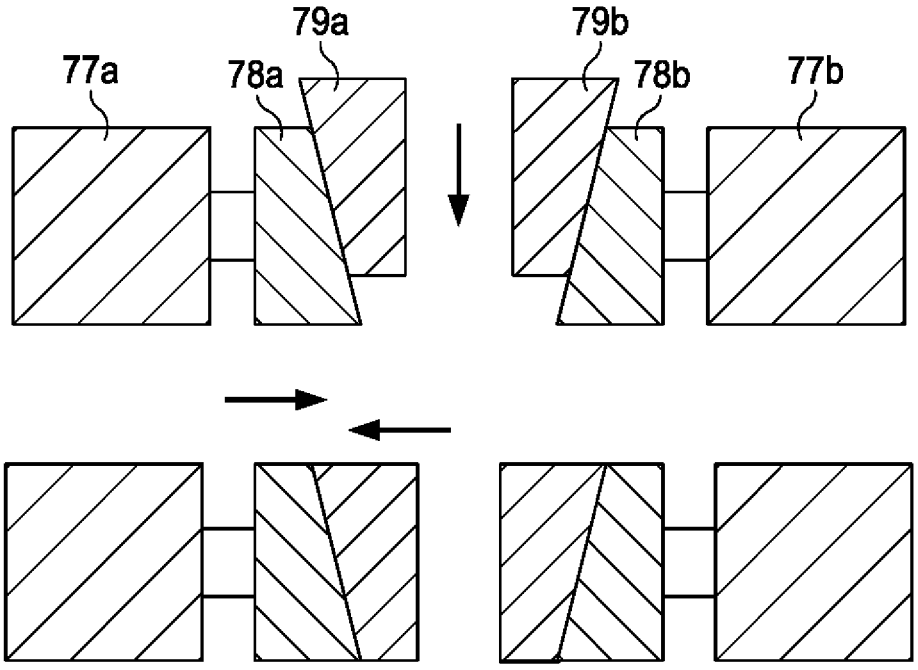
FIG. 5 depicts an alternate method of back clamp.

In an alternate embodiment, a remotely actuated spider assembly located below the drive shaft (63*a*) is able to grasp a pipe segment (5*a*). In the open position, the spider can provide sufficient space for a pipe segment (5*a*) to pass through, and when closed, the spider can firmly grasp the pipe segment (5*a*), preventing any vertical or rotational motion. Similar to the back-up clamps (71*a*, 72*a*), the spider assembly is supported below the drive shaft (63*a*) by a plurality of hydraulic or pneumatic cylinders, thus providing the spider with the ability to move vertically. FIG. 5 shows a plurality of hydraulic or pneumatic cylinders (77*a*, 77*b*) radially displaced travel horizontally moving tapered segments (78*a*, 78*b*) towards the center of the radial arrangement. The tapered segments act against a plurality of radially displaced tapered segments (79*a*, 79*b*) concentrically with the first set of segments to clamp a tubular (not shown) thru a wedging action The benefits of the embodiments described herein become further apparent during operations, for example, drilling, pipe tripping, or casing tripping. For example, embodiments depicted in FIGS. 1, 2A, and 2B can enable simultaneous down-well operations while connecting and disconnecting pipe segments, allowing a more efficient utilization of time.

As shown in the embodiment depicted in FIGS. 1, 2A, and 2B, the drill rig (10) is designed to include two top drives (60*a*, 60*b*), which can work simultaneously, enabling the first top drive (60*a*) to perform a first function, such as drilling, while the second top-drive (60*b*) performs a second function, such as preparing a subsequent pipe segment for connection to pipe string. Furthermore, as depicted in FIG. 5, additional time can be saved through use of a manifold adapted to allow fluid flow to bypass the mud pump, rather than using the conventional practice of shutting down the mud pump during connection and/or disconnection of a pipe segment. This ability results in improved well control, near consistent circulation, reduced circulation down time and the risks associated with circulation down time (i.e. stuck pipe, hole cleaning and formation stability).

In an embodiment, operations of a drill rig such as the embodiment depicted in FIG. 1 can be largely automated, reducing the amount of time between each step of the drilling, raising, lowering, connection, and/or disconnection operations. A system of sensors, such as timers and limit switches, which can be connected to a computer or an electronic controller, can be used to automatically detect the commencement and end of each operational stem and automatically initiate the next step, reducing wait time between steps, and also reducing the number of personnel required to operate the drill rig, resulting in cost savings and in improved safety by reducing the number of individuals on a rig floor.

The order of steps performed using embodiments described herein can be varied, and can allow performance of said down-well operations to be streamlined, eliminating delays normally present during pipe insertion and extraction operations, such as enabling performance of critical steps simultaneously and reducing or eliminating the delay between steps on the specific down-well operations to be performed. Shorter wait times also result in an improved ability to maintain bottom hole pressure, e.g. for managed pressure drilling and under balanced drilling operations.

Referring to FIGS. 4A-4D, an embodiment of the first and second top drives (60*a*, 60*b*) is depicted, showing steps comprising the operation of the drill rig (10). For clarity purposes, the remaining components of the drill rig (10) are not shown.

Figure 4A:
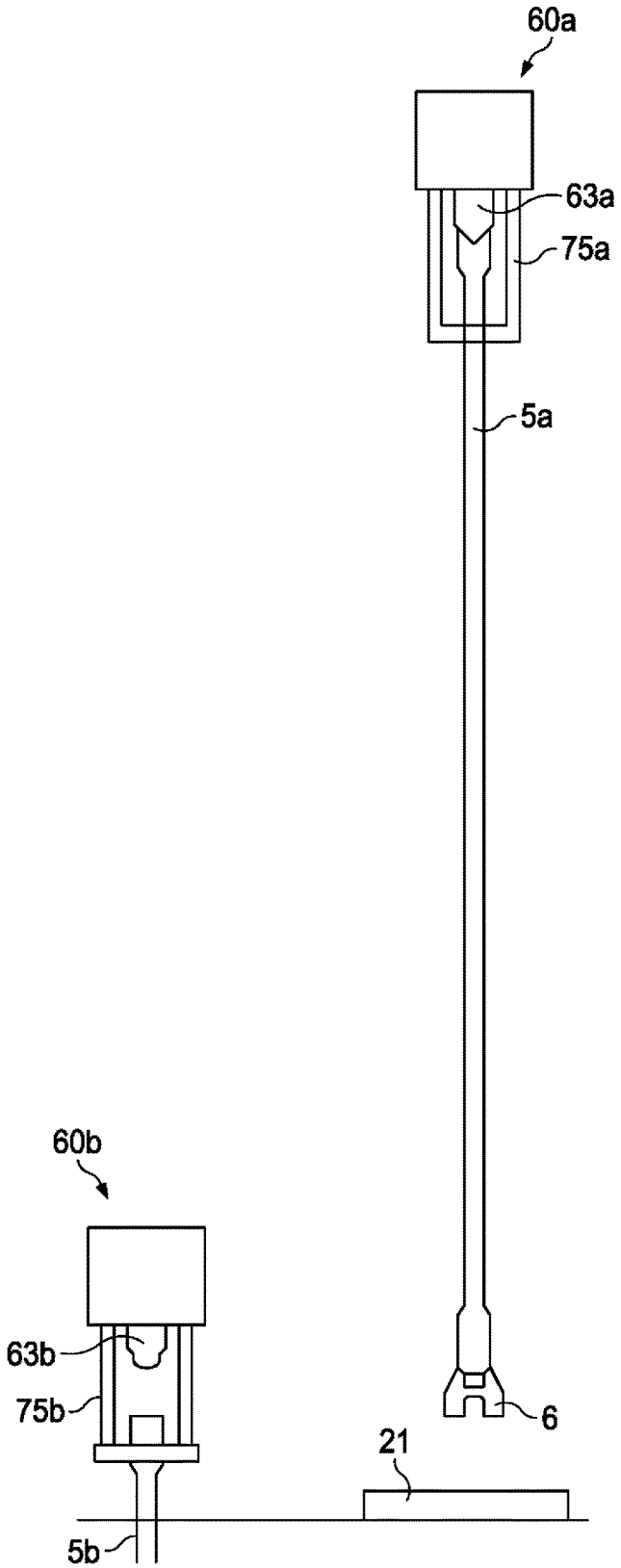
FIG. 4A depicts a diagrammatic front view of an embodiment of a mobile drilling rig usable within the scope of the present disclosure, which includes top drives A and B, in a first position.

FIG. 4A depicts the first top drive (60*a*) located at a first position (e.g. an elevated position) with a first pipe segment (5*a*) threadably connected with the first drive shaft (63*a*) such that the pipe segment hangs over the base opening (21). The second top drive (60*b*) is shown in a second position (e.g. a lowered position), with a second pipe segment (5*b*) coupled to the elevator (76*b*) associated therewith. When a drill rig is in the position shown in FIG. 4A, drilling operations are able to commence using the first top drive (60*a*) As the first top drive (60*a*) rotates the pipe segment (5*a*) and the drill bit (6), the first top drive (60*a*) can be lowered into the base opening (21) and into the wellbore, as a drilling mud pump (not shown) flows the drilling mud through the fluid passage (not shown) of the first drive shaft (63*a*), through the pipe segment (5*a*).

Figure 9:
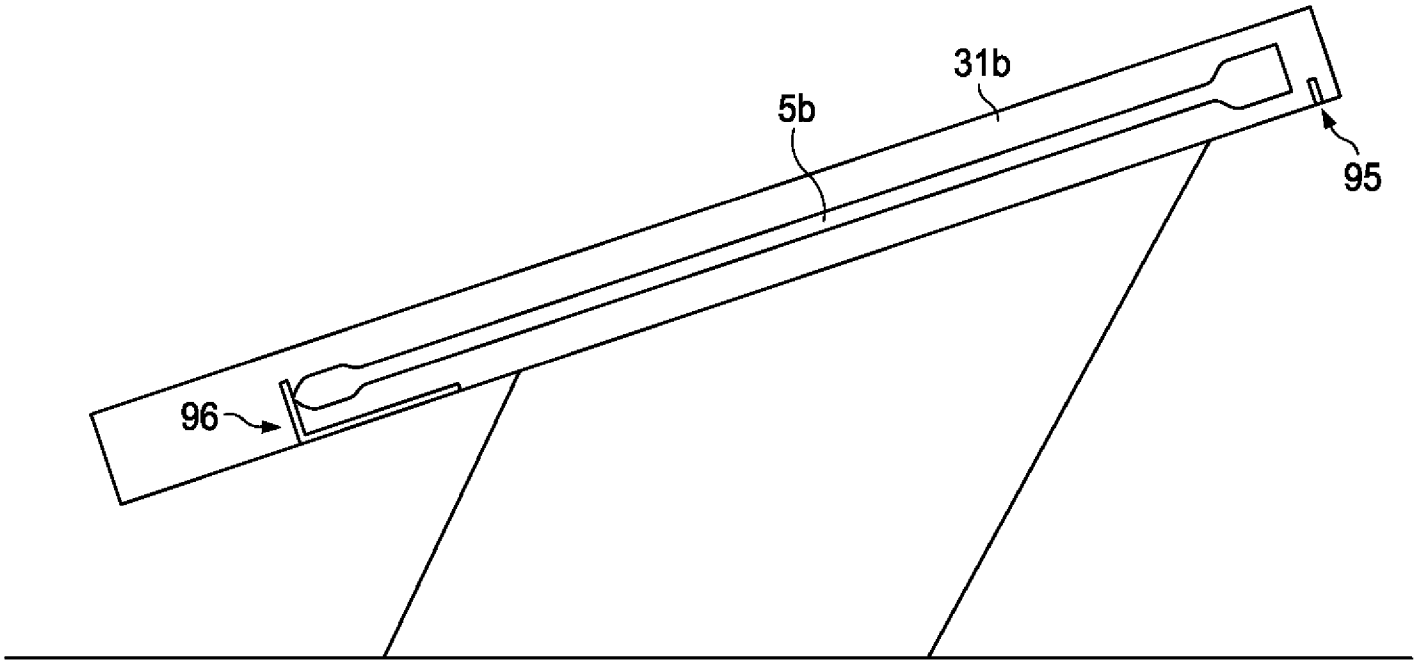
FIG. 9. depicts a pipe feeder.

The second pipe segment (5*b*) can be coupled to the elevator by a pipe feeding assembly (30*b*), as described above, which can handle and strategically place pipe segments. Specifically, pipe segments can be contained in a storage rack (not shown) located adjacent to the rig (10). Individual pipe segments can then be presented adjacent to the top drive (60*b*), where the bale assembly (75*b*) can swing out and/or extend toward the pipe segment (5*b*) to couple an elevator (76*b*) with the box end of the pipe segment (5*b*). Referring to FIG. 9, a position sensor (95) on feeder ramp (31*b*) contacts box end of pipe segment (5*b*), pipe positioner (9*b*) contacts position sensor (95) as the pipe (5*b*) travels, and the pipe length is determined. A specific embodiment of the feeder ramp (31*b*) is shown in FIGS. 1,2A and 2*b*, feeder ramps are generally known in the drilling industry, and any type of feeder ramp or other pipe handling system can be used without departing from the scope of the present disclosure.

Returning to the FIGS. 3A-3D, which depict a close-up view of the top drive (60*a*) in the course of drilling operations, it should be noted that the two top drives (60*a*, 60*b*) shown in FIGS. 4A-4D can be of identical or similar construction as the depicted first top drive (60*a*). Therefore, the operations undertaken by the second top drive (60*b*) depicted in FIGS. 4A-4D can be described with reference to FIGS. 3A-3D.

Figure 3F:
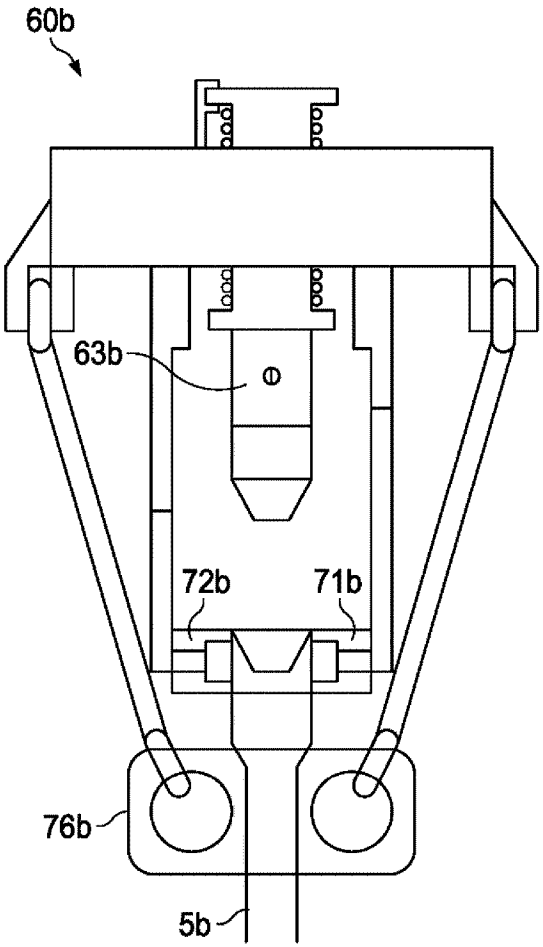
FIG. 3F depicts the second top drive assembly and back up clamp of FIG. 3E with the back-up clamp engaged with the pipe segment.
Figure 3E:
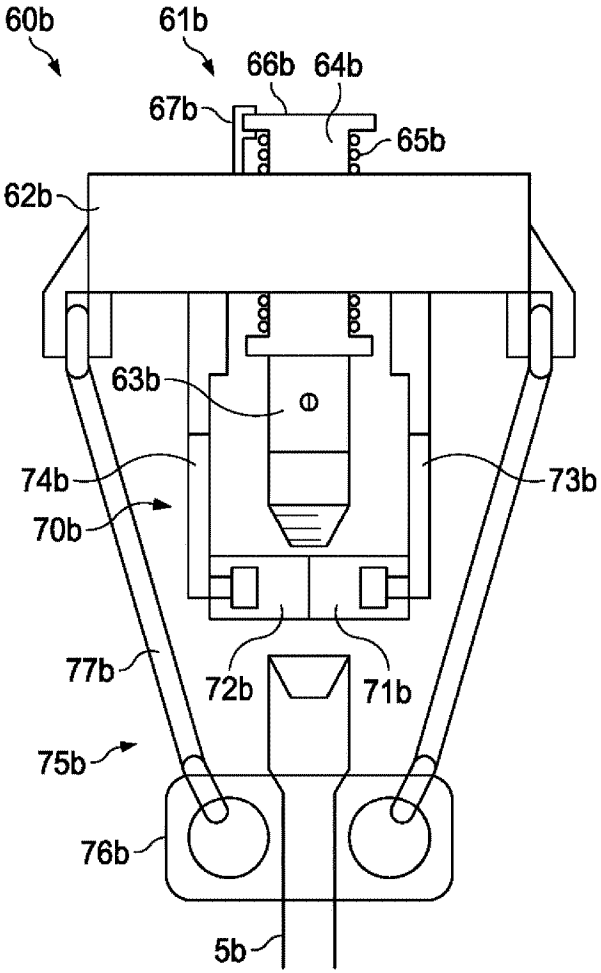
FIG. 3E depicts a diagrammatic front view of an embodiment of a second top drive assembly and back-up clamp useable within the scope of the present disclosure, positioned above a pipe segment.
Figure 3H:
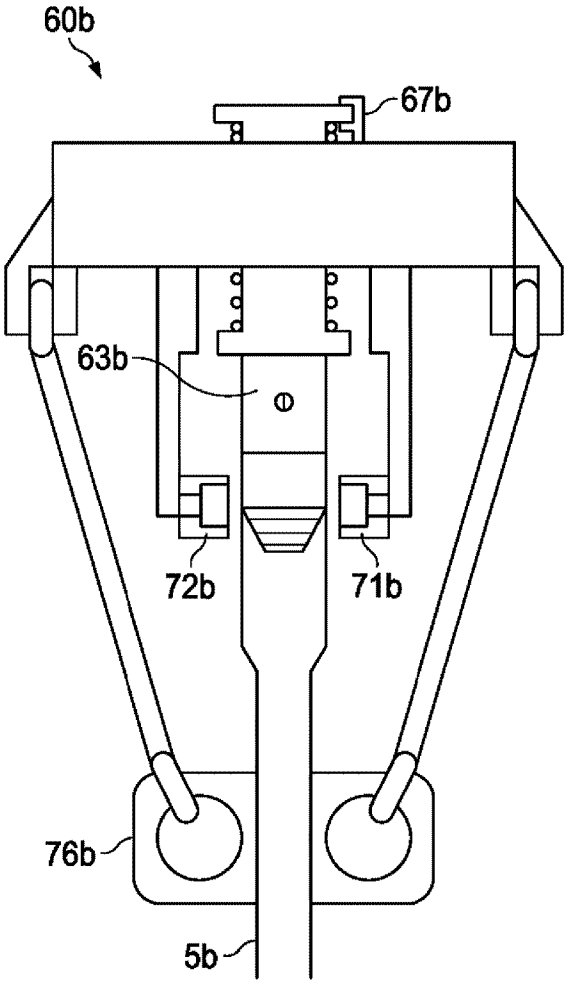
FIG. 3H depicts the top drive assembly and back-up clamp of FIG. 3E with the top drive engaged with the pipe segment.
Figure 3G:
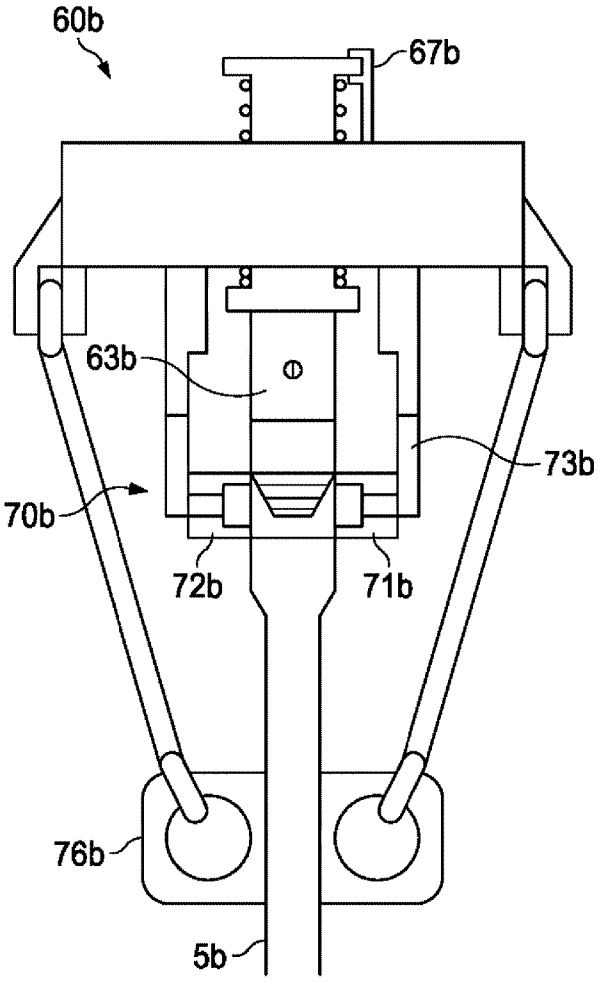
FIG. 3G depicts the top drive assembly and back-up clamp of FIG. 3E with both the back-up clamp and top drive engaged with the pipe segment.
Figure 4B:
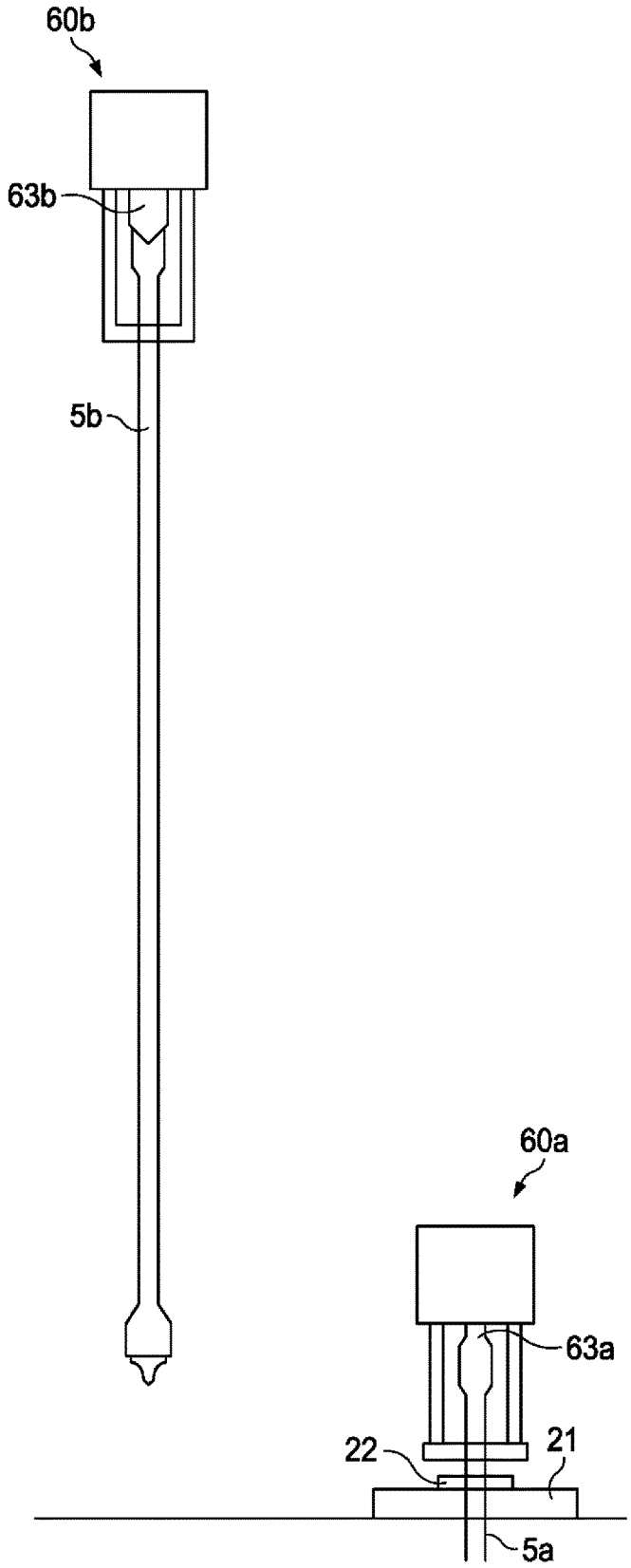
FIG. 4B depicts the mobile drilling rig of FIG. 4A in a second position.

Specifically, as the top drive (60*b*) is raised to an elevated position (as shown in FIG. 4B) the pipe segment (5*b*) becomes vertically aligned with the drive shaft (63*b*), located above, as depicted in FIG. 3F (which shows pipe segment (5*b*) aligned beneath drive shaft (63*b*)). The back-up clamps of the top drive (60*b*) can then be lowered and closed about the top end of the pipe segment (5*b*) as depicted in FIG. 3F (which shows the back-up clamps (71*b*, 72*b*) engaged with pipe segment (5*b*), preventing any further relative motion there between. After the pipe segment (5*b*) is engaged, the back-up clamps of the top drive (60*b*) can be raised upward, lifting the pipe segment (5*b*) from the elevator to abut the threaded end of the drive shaft (63*b*), as illustrated in FIG. 3G (which shows the backup clamps (71*b*, 72*b*) raised such that the pipe segment (5*b*) abuts the drive shaft (63*b*)). FIG. 3G shows a position sensor (67*b*), which can detect contact between the pipe segment (5*b*) and the drive shaft (63*b*), such that upward movement of the back-up clamps (71*b*, 72*b*) can be ceased responsive to detection of this contact. Identical or similar components can be used in conjunction with the top drive (60*a*). The drive motor (not shown) can then be actuated, causing the male threads of the drive shaft (63*b*) to engage the female threads of the pipe segment (5*b*). Once the drive shaft (63*b*) is engaged with the pipe segment (5*b*), the back-up clamps of the top drive (60*b*) can be disengaged from the pipe segment (5*b*) as illustrated in FIG. 3H (which depicts pipe segment (5*b*) threaded to drive shaft (63*b*), while back-up clamps (71*b*, 72*b*) are disengaged from the pipe segment). While the operations described above with reference to the top drive (60*b*) are performed, the top drive (60*a*) can be used to continue drilling and/or lowering operations, moving vertically downward until it reaches its lowered position, as shown in FIG. 4B.

Figure 8:
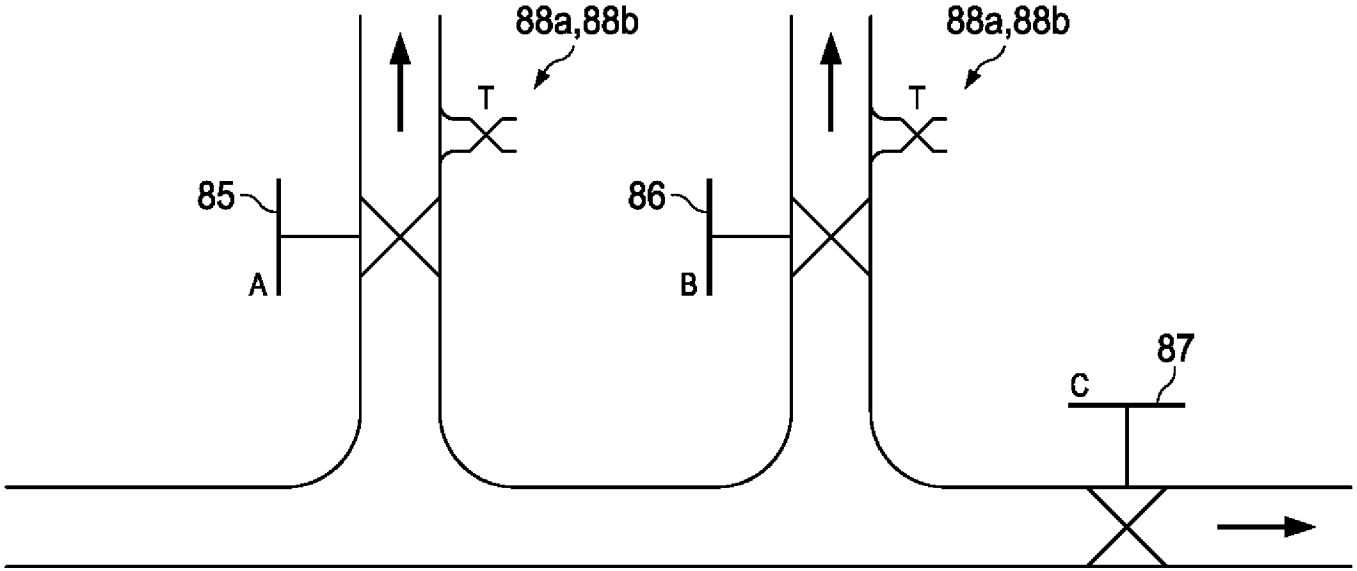
FIG. 8. depicts a pumping manifold.

FIG. 4B depicts the top drive (60*b*) in an elevated position, having a pipe segment (5*b*) engaged with the drive shaft (63*b*) thereof, and the top drive (60*a*) in a lowered position, having a pipe segment (5*a*) engaged therewith and mostly inserted through the base opening (21) and into the wellbore. At this stage of operations the flow of drilling mud (not shown) can be diverted by a manifold shown in FIG. 8 to a tank (not shown) or alternate path by opening valve (87) and closing valve (85) to top drive (60*a*), bleed off valve (88*a*) is opened to drain and/or suction the drilling mud from the drive shaft (63*a*) to prevent the drilling mud from draining on the platform (20). Once slips (22) are engaged with the pipe segment (5*a*), the drive motor can turn the drive shaft (63*a*) to disengage the threads of the drive shaft (63*a*) from those of the pipe segment (5*a*). The raising assembly (50) can then move along the guide rails (41), shifting the horizontal position of the top drives (60*a*, 60*b*), such that the top drive (60*b*) and engaged pipe segment (5*b*) are aligned over the wellbore, while the top drive (60*a*) is positioned suitably for engagement with a subsequent pipe segment (5*c*).

Figure 4C:
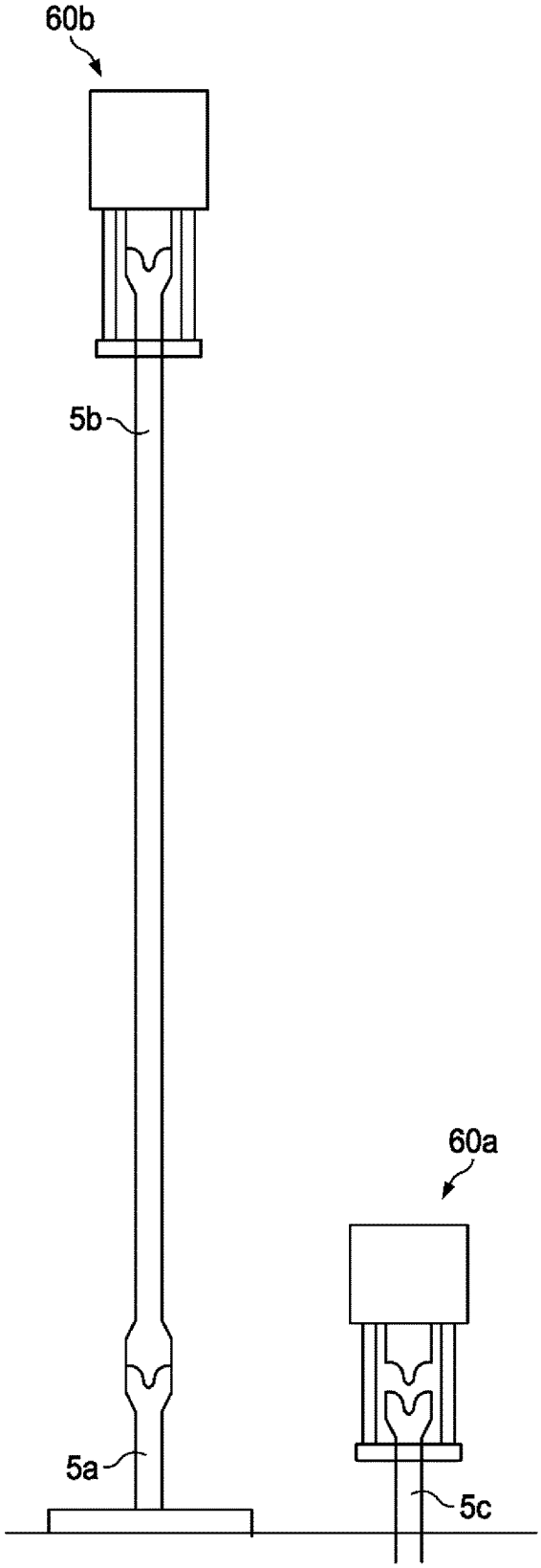
FIG. 4C depicts the mobile drilling rig of FIG. 4A in a third position.

As such, when the depicted system is in the position shown in FIG. 4C, segment (5*b*) contacts with the female threads of the first pipe segment (5*a*) located within the wellbore. Once contact is made, the drive motor (not shown) of the top drive (60*b*) engages the second drive shaft (63*b*) to rotate the suspended pipe segment (5*b*), connecting it with the first pipe segment (5*a*) located within the wellbore. Once the threads of the pipe segments (5*a*, 5*b*) are fully engaged, the flow of the drilling mud (not shown) can be directed from the mud pump (not shown) to the top drive (60*b*) and the slips are removed, as depicted in FIG. 4C, whereby the drilling process can continue by rotating and lowering the pipe string in the down-well direction.

While the pipe segments (5*a*, 5*b*) are being connected, and during the drilling operations that follow, the top drive (60*a*) can be engaged with a subsequent pipe segment (5*c*), in the manner described above with reference to FIGS. 3A-3D. For example, as depicted in FIG. 4C, the top drive (60*a*), in a lowered position, where the subsequent pipe segment (5*c*) can be coupled to the elevator (76*a*) associated with the top drive (60*a*) through the process described above or any other suitable process known in the art.

Once the subsequent pipe segment (5*c*) is coupled to the first elevator (76*a*), the top drive (60*a*) can be moved upward, lifting the pipe segment (5*c*) from the feeder ramp (31*a*) until it is in vertical alignment below the drive shaft (63*a*). Pipe segment (5) length is measured as described above and referencing FIG. 9. As described above, when the top drive (60*a*) reaches an elevated position with the pipe segment (5*c*) aligned with the drive shaft (63*a*), as depicted in FIG. 3B, the back-up clamps (71*a*, 72*a*) can be engaged with the top end of the pipe segment (5*c*), preventing any further relative motion there between. Once the pipe segment is engaged, the back-up clamps can move (71*a*, 72*a*) vertically, lifting the pipe segment from the elevator (76*a*)

into contact with the threaded end of the drive shaft (63*a*), as depicted in FIG. 3C. A position sensor (67*a*) can detect contact between the pipe segment (5*c*) and the drive shaft (63*a*), and the backup assembly (70*a*) can cease movement of the clamps (71*a*, 72*a*) responsive to detection of this contact. The drive motor (not shown) of the top drive (60*a*) can then be activated, causing the male threads of the drive shaft (63*a*) to engage the female threads of the pipe segment (5*c*). Sensors (not shown) detect the number of revelations of the drive shaft and torque thereof and cease rotation of the driveshaft once certain values are met indicating the drive shaft (63*a*) is fully engaged with pipe segment (5*c*), the back-up clamps (71*a*, 72*a*) travel vertically down position sensor (76*a*) can detect that weight of the pipe segment (5*c*) is no longer being supported by back-up clamps (71*a*, 72*a*), back-up clamps (71*a*,72*a*) can be disengaged from the pipe segment (5*c*).

Figure 4D:
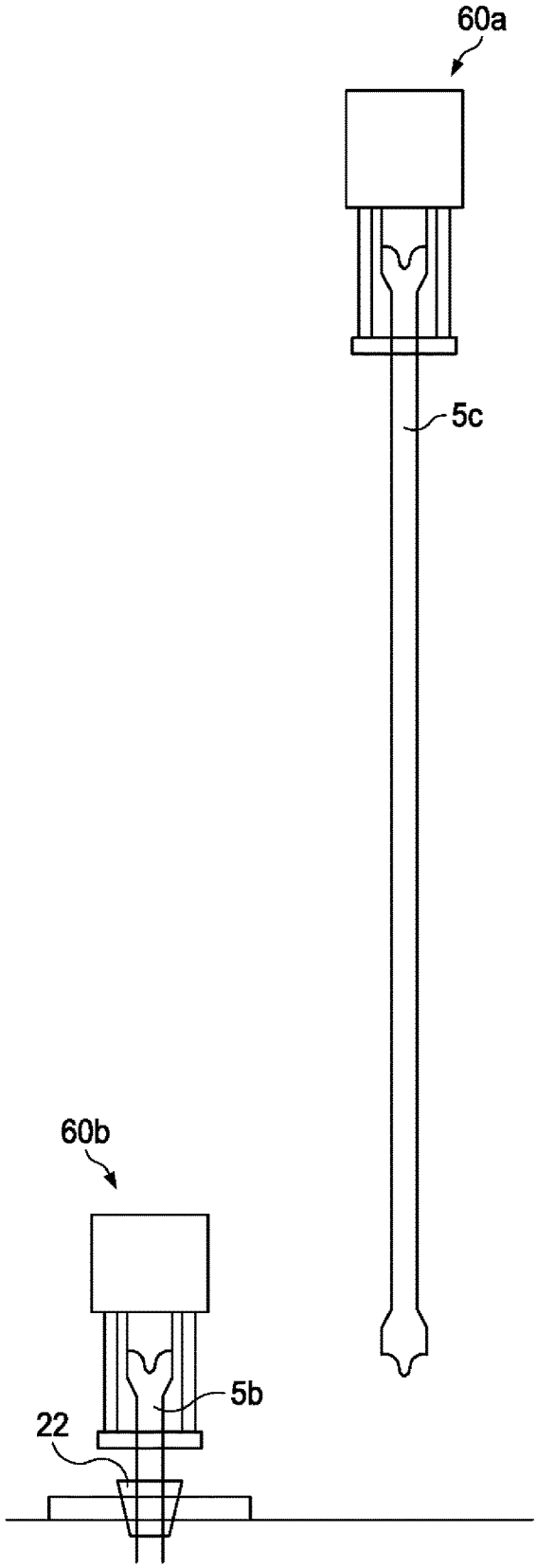
FIG. 4D depicts the mobile drilling rig of FIG. 4A in a fourth position.

While the subsequent next pipe segment (5*c*) is engaged with the top drive (60*a*), the top drive (60*b*) can be used to continue drilling and/or lowering operations, descending to a lowered position and inserting the pipe segment (5*b*) into the wellbore, as depicted in FIG. 4D. At this stage of operations, the flow of the drilling mud (not shown) are able to be diverted to the tank (not shown) and the drive shaft (63*b*) disengaged from the pipe segment (5*b*), back-up clamps (71*b*, 72*b*) are set about the pipe segment (5*b*), the drive shaft (63*b*) can be turned in the opposite direction, disengaging the top drive (60*b*) from the pipe segment (5*b*). Once the pipe segment (5*b*) is disconnected from the drive shaft (63*b*) and the subsequent pipe segment (5*c*) is engaged with the drive shaft (63*a*) located in the elevated position, the top drives (60*a*, 60*b*) can shift laterally, as described previously, aligning the top drive (60*a*) and associated pipe segment (5*b*) over the base opening (21), and moving the top drive (60*b*) to a position suitable for engagement with the next pipe segment, as depicted in FIG. 4A. This process can be repeated to engage and lower any number of pipe segments into a wellbore, and can be performed in reverse to remove any number of pipe segments from a wellbore. Further, while the process above is described with reference to drill pipe and drilling operations, it should be understood that embodiments described herein can also be applicable with casing, production tubing, and other types of tubulars.

Figure 6A:
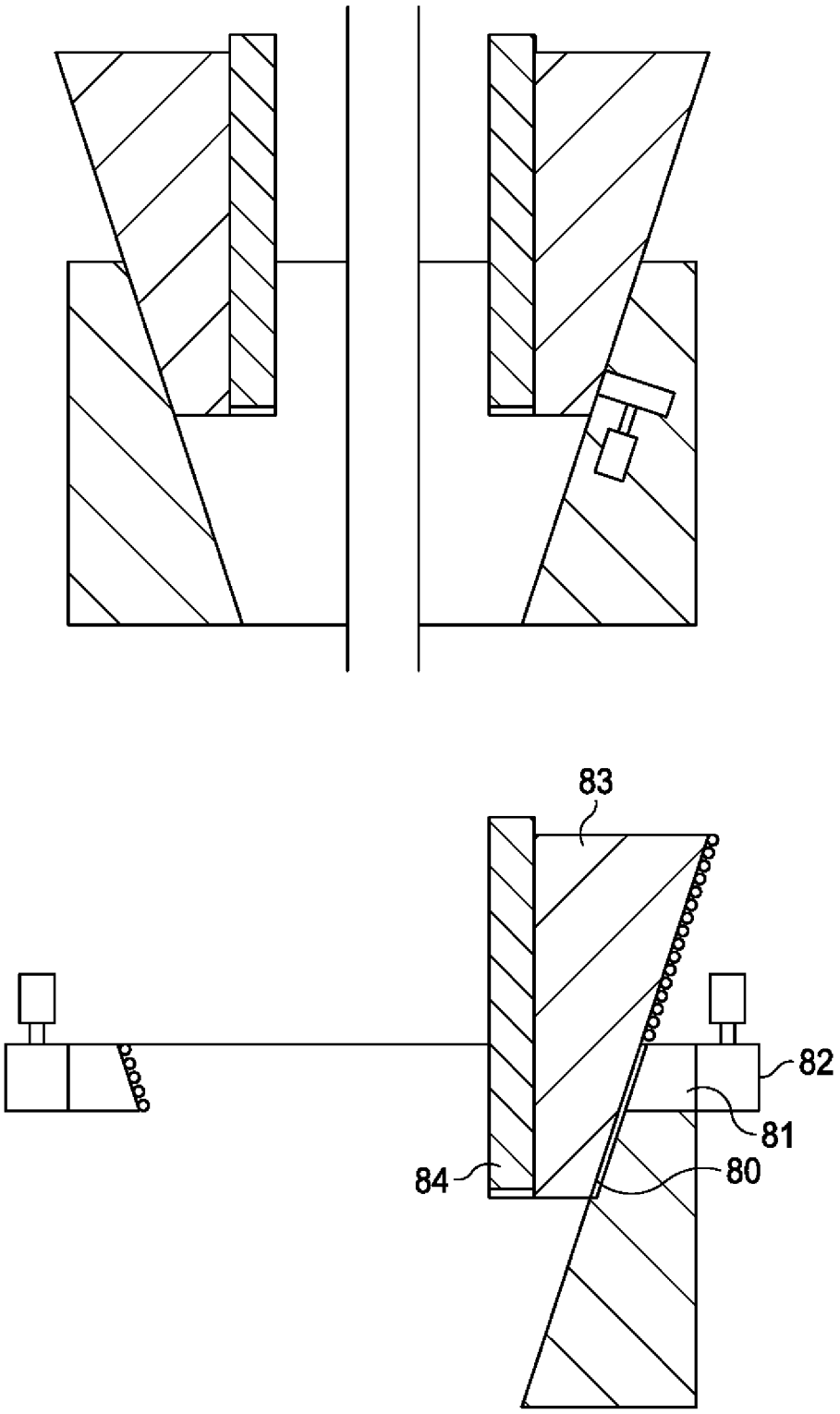
FIGS. 6A and 6B depict a self-clamping rotary table.
Figure 6B:
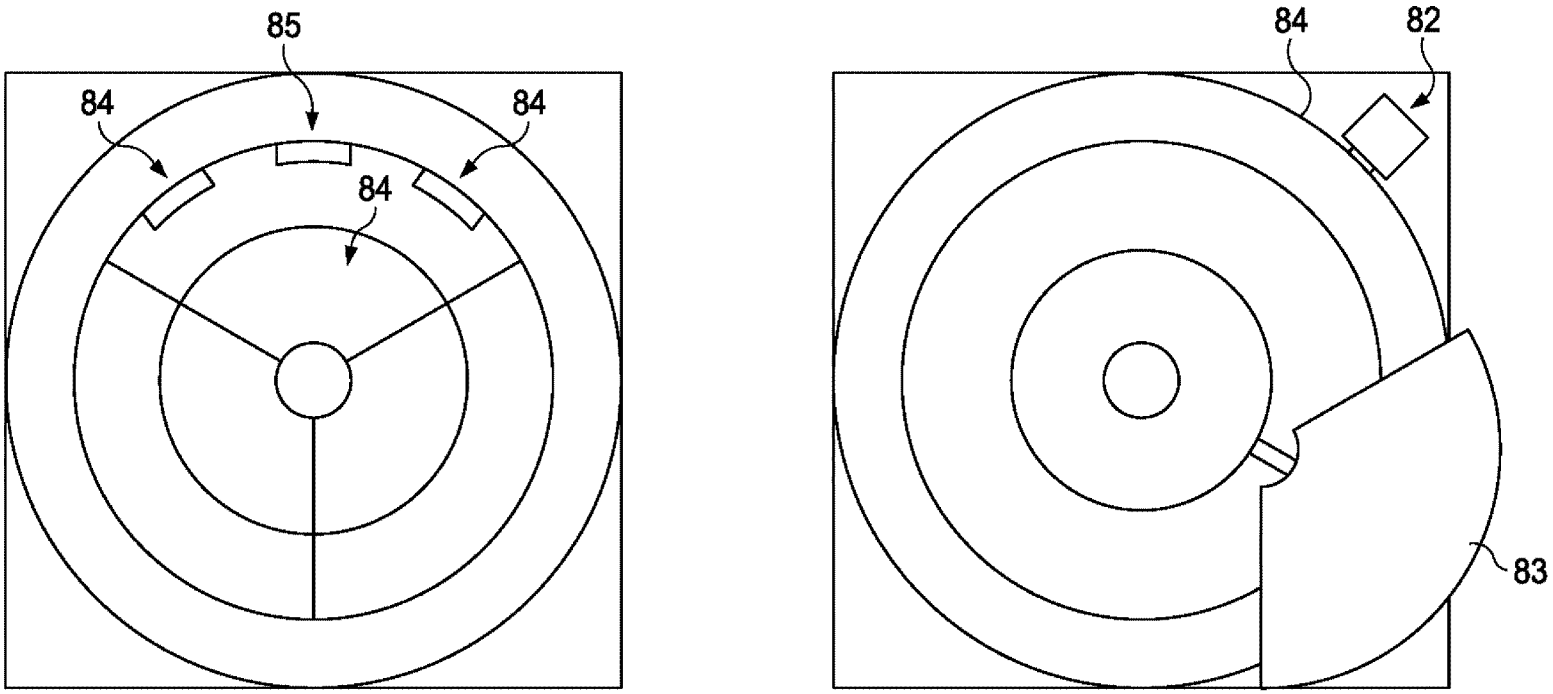

FIG. 6A depicts an alternate method of clamping tubulars in the base opening (21). A plurality of radially displaced wedged segments (83) is concentric with circular housing (80) and threadably engages the drive motor (82) the drive ring (81) travels wedged segments vertically downwards to clamp a tubular (not shown) concentric with the base opening (21). Reversing the rotation of the drive motor (82) travels the wedged segments (83) vertical direction upwards unclamping the tubular. Dowels (84) engage the wedged segments (83) with the circular housing (80) to retain the wedged segments (83), a bushing (84) is inserted in the wedged segments to adapt the segments to different diameters of tubulars.

Figure 7B:
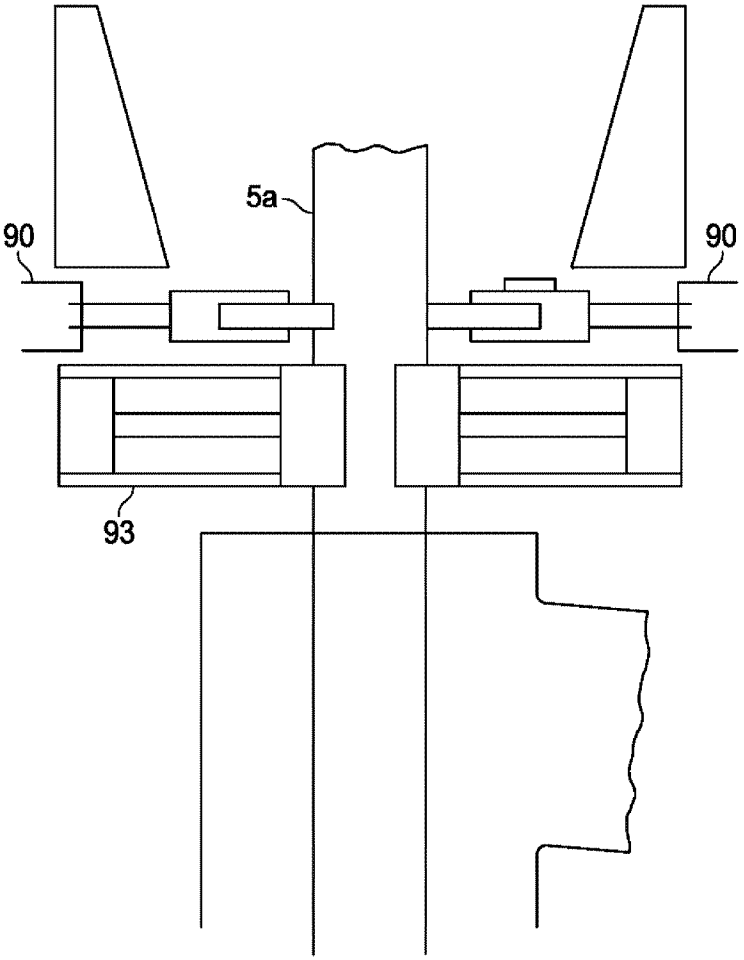
FIGS. 7A and 7B depict tubular centralizer and pipe clamp.
Figure 7A:
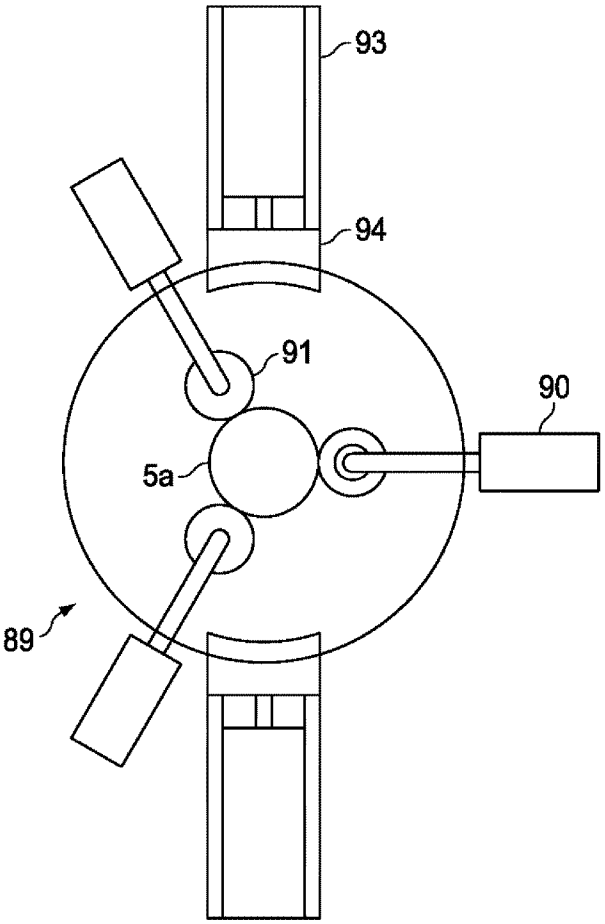

FIG. 7A. depicts an alternate embodiment of a tubular centralizer and clamp. A pipe segment (5*a*) is grasped by a remotely actuated spider (89) assembly located below the base opening (21). In the open position, the spider provides sufficient space for a pipe segment (5*a*) to pass through. FIG. 9*a* shows a plurality of hydraulic or pneumatic cylinders (90) radially displaced, thus providing the rollers (91) the ability to travel horizontally and when closed, the rollers (91) firmly grasp the pipe segment (5*a*), centralizing the pipe segment (5*a*) to the base opening (21) and thus the well bore. The spider assembly optionally includes a series of linkages (not shown) to cause the rollers (91) to engage the pipe segment (5*a*) simultaneously.

FIG. 7A. further depicts a plurality of hydraulic or pneumatic cylinders (93) radially displaced around the base opening center (21), thus providing clamps (94) with the ability to move horizontally to engage the pipe segment (5*a*), preventing any vertical or rotational motion.

From the foregoing description, one of ordinary skill in the art can easily ascertain the essential characteristics of this disclosure, and without departing from the spirit and scope thereof, can make various changes and modifications to adapt the disclosure to various usages and conditions. For example, we do not mean for references such as above, below, left, right, and the like to be limiting but rather as a guide for orientation of the referenced element to another element. A person of skill in the art should understand that certain of the above-described structures, functions, and operations of the above-described embodiments are not necessary to practice the present disclosure and are included in the description simply for completeness of an exemplary embodiment or embodiments. In addition, a person of skill in the art should understand that specific structures, functions, and operations set forth in the above-described referenced patents and publications can be practiced in conjunction with the present disclosure, but they are not essential to its practice.

The invention can be embodied in other specific forms without departing from its spirit or essential characteristics. A person of skill in the art should consider the described embodiments in all respects only as illustrative and not restrictive. The scope of the invention is, therefore, indicated by the appended claims rather than by the foregoing description. A person of skill in the art should embrace, within their scope, all changes to the claims which come within the meaning and range of equivalency of the claims. Further, we hereby incorporate by reference, as if presented in their entirety, all published documents, patents, and applications mentioned herein.

The invention claimed is:

1. A rig comprising:

a. a plurality of tubular rotational devices:

b. a derrick assembly for supporting the plurality of tubular rotational devices, wherein each of the plurality of tubular rotational devices is slidably disposed to move the tubular rotational devices toward a single wellbore and away from the wellbore, the wellbore having a wellbore axis; and c. a plurality of lifting assemblies, wherein the plurality of lifting assemblies are operatively connected to the plurality of tubular rotational devices and a first lifting assembly is capable of moving a first tubular rotational device vertically inline with the wellbore while a second lifting assembly is capable of independently moving a second tubular rotational device vertically out of alignment with the wellbore, wherein the first tubular rotational device is capable of rotating and lifting a first tubular segment inline with the wellbore while the second tubular rotational device is lifting and rotating a second tubular segment out of alignment with the wellbore; and wherein each of the plurality of tubular rotational devices are spaced a fixed distance from each other in a plane perpendicular to the wellbore axis.

2. A method of assembling a tubular segment string using the rig of claim 1, the method comprising the steps of:

a. coupling the first tubular segment having a top and a bottom end with the first tubular rotational device;

b. moving the first tubular segment in a horizontal direction relative to a wellbore axis;

c. engaging the first tubular segment with a tubular segment string in the wellbore;

d. lowering the first tubular segment into the wellbore;

e. coupling the second tubular segment having a top and a bottom end with the second tubular rotational device;

f. moving the second tubular segment in a horizontal direction relative to the wellbore axis;

g. engaging the bottom end of the second tubular segment with the top end of the first tubular segment and lowering the second tubular segment into the wellbore; and h. repeating at least steps a.-d. for additional tubular segments; and wherein coupling the tubular segment with the tubular rotational device comprises a. engaging the tubular segment with an elevator assembly;

b. engaging the tubular segment with a clamp assembly;

c. lifting the tubular segment upward to contact the tubular rotational device; and d. coupling the top end of the tubular segment to a drive shaft.

3. The method of claim 2, wherein the clamp assembly is capable of moving the top end of the tubular segment toward the drive shaft.

4. The method of claim 2, wherein the elevator assembly comprises two rotators in an axis substantially parallel with one another and an outer diameter of the tubular segment is determined by a distance between the two rotators.

5. The method of claim 2, wherein the tubular segment is clamped by the clamp assembly to prevent rotation and vertical travel of the tubular assembly when the tubular segment is over the wellbore.

6. A method of assembling a tubular segment string using a rig comprising:

a. a plurality of tubular rotational devices:

b. a derrick assembly for supporting the plurality of tubular rotational devices, wherein each of the plurality of tubular rotational devices is slidably disposed to move the tubular rotational devices toward a single wellbore and away from the wellbore, the wellbore having a wellbore axis; and c. a plurality of lifting assemblies, wherein the plurality of lifting assemblies are operatively connected to the plurality of tubular rotational devices and a first lifting assembly is capable of moving a first tubular rotational device vertically inline with the wellbore while a second lifting assembly is capable of independently moving a second tubular rotational device vertically out of alignment with the wellbore, wherein the first tubular rotational devices is capable of rotating and lifting a first tubular segment inline with the wellbore while the second tubular rotational device is lifting and rotating a second tubular segment out of alignment with the wellbore;

the method comprising the steps of:

a. coupling the first tubular segment having a top and a bottom end with the first tubular rotational device;

b. moving the first tubular segment in a horizontal direction relative to a wellbore axis;

c. engaging the first tubular segment with a tubular segment string in the wellbore;

d. lowering the first tubular segment into the wellbore;

e. coupling the second tubular segment having a top and a bottom end with the second tubular rotational device;

f. moving the second tubular segment in a horizontal direction relative to the wellbore axis;

g. engaging the bottom end of the second tubular segment with the top end of the first tubular segment and lowering the second tubular segment into the wellbore; and h. repeating at least steps a.-d. for additional tubular segments;

further comprising preventing gas from the wellbore from venting into the atmosphere by employing at least one tubular segment with a check valve operatively connected to the tubular segment; and wherein the check valve is opened by engaging the tubular rotational device with the tubular segment.

* * * * *